US005705043A

United States Patent [19]

Zwerner et al.

[11] Patent Number: 5,705,043

[45] Date of Patent: Jan. 6, 1998

[54] ELECTROPLATING APPARATUS

[75] Inventors: Eric Zwerner, Commugny; Mariano Aparicio, Romanel/Lausanne, both of Switzerland

[73] Assignee: Suntec Trading AG, Greng, Switzerland

[21] Appl. No.: 637,820

[22] PCT Filed: Nov. 4, 1994

[86] PCT No.: PCT/GB94/02398

§ 371 Date: Jun. 26, 1996

§ 102(e) Date: Jun. 26, 1996

[87] PCT Pub. No.: WO95/12696

PCT Pub. Date: May 11, 1995

[30] Foreign Application Priority Data

Nov. 4, 1993 [GB] United Kingdom ..... 93227698

[51] Int. Cl.[6] ..... C25D 17/00

[52] U.S. Cl. ..... 204/202; 204/224 R

[58] Field of Search ..... 204/202, 224 R, 204/206

[56] References Cited

U.S. PATENT DOCUMENTS

| | | | |
|---|---|---|---|
| 4,155,815 | 5/1979 | Francis et al. | 204/224 R X |
| 4,405,431 | 9/1983 | Pfeifer et al. | 204/224 R |
| 4,425,213 | 1/1984 | Laverty et al. | 204/224 R |
| 4,582,583 | 4/1986 | Laverty et al. | 204/224 R X |
| 4,921,583 | 5/1990 | Sewell et al. | 204/224 R X |

FOREIGN PATENT DOCUMENTS

663038 A5 11/1987 Switzerland .

*Primary Examiner*—Donald R. Valentine

*Attorney, Agent, or Firm*—McAulay Fisher Nissen Goldberg & Kiel, LLP

[57] ABSTRACT

There is disclosed apparatus for selectively electrolytically treating defined regions of a continuously moving conductive workpiece. The apparatus comprises means for conveying the workpiece through an electrolytic treatment zone of the apparatus where it is contacted with a treatment electrolyte; the conveying means affording masking means to mask the workpiece so that electrolyte contacts only the defined regions; the conveying means comprising an endless chain affording indexing means by which the workpiece is located in register with the masking means; means for supplying electrolyte to the masked workpiece; and means for passing a current between the workpiece as one electrode and another electrode; the means for conveying the workpiece comprising two endless chain conveyors made of articulated links of electrically non-conductive material between which the workpiece is held whilst it is passed through the treatment zone.

Indexing means may be provided for ensuring that the two endless chain conveyors remain in register with each other at least in the treatment zone.

28 Claims, 17 Drawing Sheets

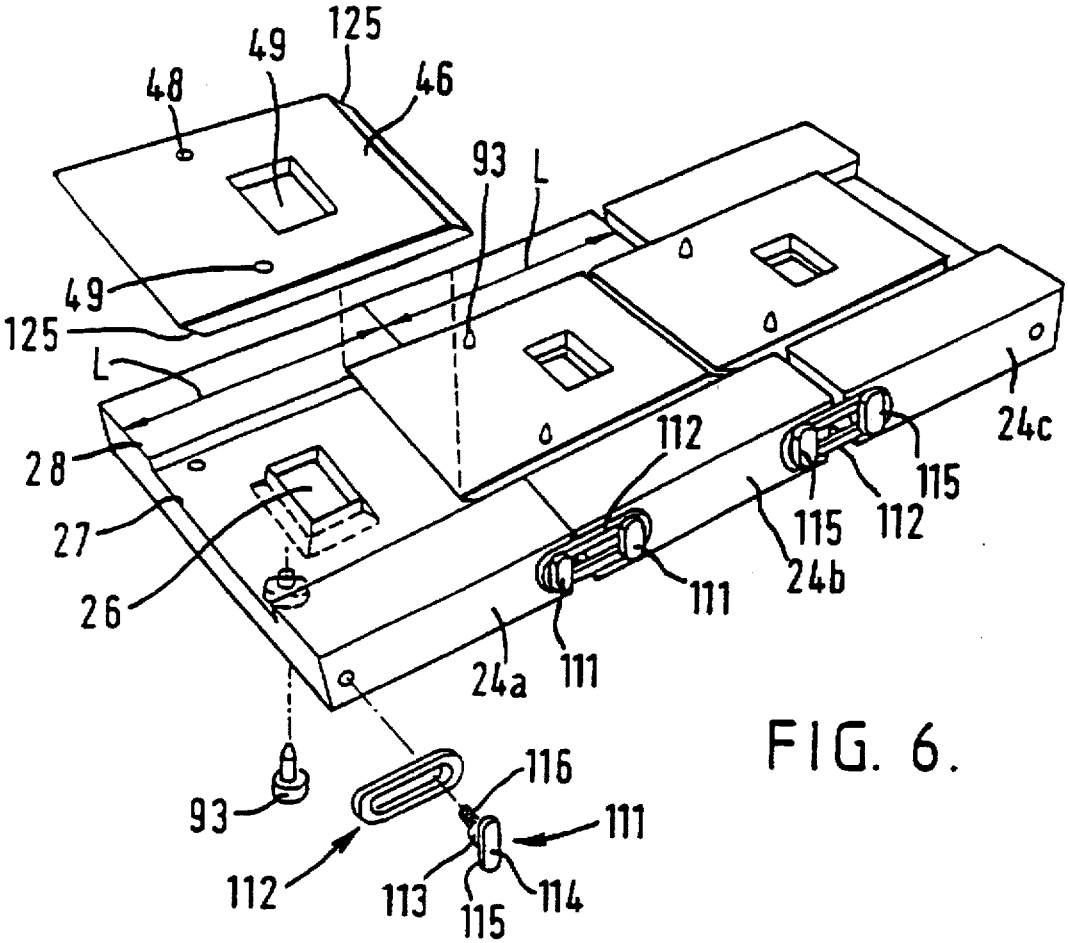
FIG. 6.
FIG. 7.
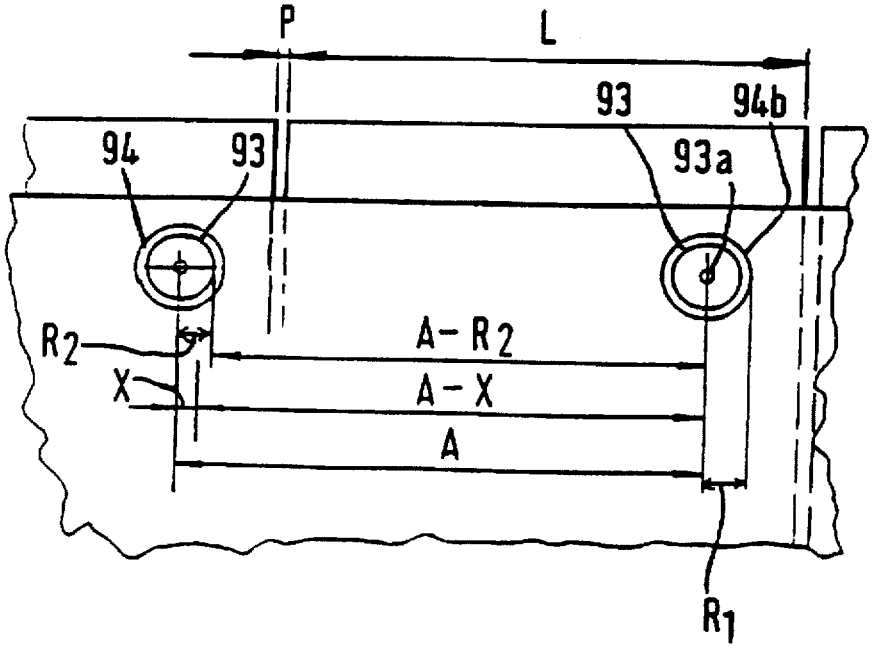

ELECTROPLATING APPARATUS

BACKGROUND OF THE INVENTION

1. Field of the Invention

The present invention relates to an electrolytic cell for selective plating of certain chosen regions on a continuously moving metal or metallized strip.

Such cells are used on machines intended more particularly for surface treatments and for plating of connectors for integrated circuits (lead frames) with precious metals.

2. Description of the prior art

We are aware of the following publications GB-A-2117405 (National Semiconductor); GB-A-2094344 (Owen); WO 81/03187 (Kontakta); USP-A-4155815 (Francis); and "Metal Finishing" published by Eugene B. Madel, January 1987 pages 29–31. None of these disclose the features to which the present case is directed but have been cited as indicating the technological background.

SUMMARY OF THE INVENTION

The present invention provides apparatus for selectively electrolytically treating defined regions of a continuously moving conductive workpiece comprising, means for conveying the workpiece through an electrolytic treatment zone of the apparatus where it is contacted with a treatment electrolyte; the conveying means affording masking means to mask the workpiece so that electrolyte contacts only the defined regions; the conveying means comprising an endless chain affording indexing means by which the workpiece is located in register with the masking means; means for supplying electrolyte to the masked workpiece; and means for passing a current between the workpiece as one electrode and another electrode. Such apparatus will be referred to as apparatus of the type described.

The subject matter of the present case extends to a number of aspects of inventive nature. Any aspect or any two or more aspects may be used in any compatible combination with apparatus of the type described, and the subject matter of the present case extends to all such combinations.

According to a first aspect the means for conveying the workpiece comprises two endless chain conveyors made of articulated links of electrically non-conductive material between which the workpiece is held whilst it is passed through the treatment zone.

A second aspect is that indexing means may be provided for ensuring that the two endless chain conveyors remain in register with each other at least in the treatment zone.

The indexing means comprise cooperating interengaging structures provided by the said chains.

A third aspect is that each of the endless chain conveyors is provided with a support structure at least in the treatment zone. Preferably the support structures are mounted for movement towards and away from each other.

A fourth aspect is than the support structures may be provided with means for holding then in fixed mutually opposed relationship, in which condition the endless chain conveyors are free to slide therebetween in register with one another. The means for holding the support structures in fixed mutually opposed relationship preferably comprise indexing means and clamping means. The indexing means may comprise cooperating interengaging structures provided by or carried on the said support structures.

A fifth aspect is that the two endless chain conveyors may be keyed to each other at least in the treatment zone and only one of the conveyors need be provided with driving means, the driven conveyor acting to carry the other conveyor in register with itself through the treatment zone. The conveyor may be pulled or pushed through the treatment zone.

A sixth aspect is that at least one of the endless chain conveyors may be provided with a support structure at least in the treatment zone and is preferably keyed to the support structure at least in the treatment zone in such a way as to hold the conveyor to the support structure whilst permitting the conveyor to slide along the said structure.

Preferably both of the endless chain conveyors are provided with a support structure at least in the treatment zone and both are keyed to their respective support structure at least in the treatment zone in such a way that each conveyor is held to its respective support structure whilst being permitted to slide along the said structure. A conveyor may be keyed to its support by cooperating means comprising a cooperating protuberance or protuberances and a recess or recesses. The protuberance or protuberances are preferably located on the chain conveyor and the recess or recesses are located in the support. In one form of this aspect the protuberances and recesses afford essentially triangular cross sections transverse to the direction of movement of the chain conveyor.

A seventh aspect is that one or both of the endless chain conveyors may be driven by frictional contact with a belt.

An eighth aspect is that each endless chain conveyor is carried on a separate support structure, the support structures and thus the chains being movable relative to each other so as to be capable of being brought together so as to engage a workpiece between them and to be brought apart.

A ninth aspect is that one or both support structures may carry a belt adapted to frictionally engage the endless chain conveyor which is on its support and to drive the said conveyor.

A tenth aspect is that the or each drive belt may have a compressible polymer surface which is located to engage the face of the links of the chain conveyor which is remote from the workpiece, and this engagement occurs in the treatment zone.

An eleventh aspect is that the support structures each may carry means for keying the chains to the support structure at least in the treatment zone.

A twelfth aspect is that each endless chain is provided with support means on at least a part of its return run.

A thirteenth aspect is that the links of at least one of the chain conveyors may have apertures therein defined by the said masking means and electrolyte venting means may be proved to vent each such aperture so as to reduce any tendency to build up of electrolysis products.

The links of both endless chain conveyors may be provided with apertures through which electrolyte may be supplied to the workpiece.

A fourteenth aspect is that the apertures may be positioned in the links of the two chains in such a way that in opposed links of the two chains, which links are in register in the treatment zone, the apertures are not in register.

A fifteenth aspect is that the apertures may be positioned in the links of the two chains so as to be in register when the links are opposed to each in register in the treatment zone.

Means are preferably provided for feeding electrolyte to both faces of the workpiece.

A sixteenth aspect is that means may be provided for feeding electrolyte through one conveyor from one face of the workpiece past the workpiece and out via the other face of the workpiece through the other conveyor.

Anodes are preferably provided opposite each face of the workpiece.

In a preferred form of the invention apparatus for selectively electrolytically treating defined regions of a continuously moving conductive workpiece comprises, means for conveying the workpiece through an electrolytic treatment zone of the apparatus where it is contacted with a treatment electrolyte; the conveying means affording masking means to mask the workpiece so that electrolyte contacts only the defined regions; the conveying means comprising an endless chain affording indexing means by which the workpiece is located in register with the masking means; means for supplying electrolyte to the masked workpiece; and means for passing a current between the workpiece as one electrode and another electrode; the means for conveying the workpiece comprising two endless chain conveyors made of articulated links of electrically non-conductive material between which the workpiece is held whilst it is passed through the treatment zone; indexing means are provided for ensuring that the two endless chain conveyors remain in register with each other at least in the treatment zone; each endless chain conveyor is carried on a separate support structure, the support structures and thus the chains being movable relative to each so as to be capable of being brought together so as to engage a workpiece between them and to be brought apart; both of the endless chain conveyors are provided with a support structure at least in the treatment zone and both are keyed to their respective support structure at least in the treatment zone in such a way that each conveyor is held to its respective support structure whilst being permitted to slide along the said structure; and one or both support structures carries belt means adapted to frictionally engage the endless chain conveyor which is on its support and to drive the said conveyor.

BRIEF DESCRIPTION OF THE DRAWINGS

The invention may be put into practice in various ways and a number of specific embodiments will be described to illustrate the invention and the several aspects with reference to the accompanying drawings in which:

FIG. 6 is a diagrammatic perspective view in more detail and from above of one form of chain conveyor which may be used in the first embodiment shown horizontally disposed and showing three links of one of the chains;

FIG. 7 shows in very enlarged diagrammatic form detail of a workpiece having a repetitive pattern and having guide holes and is intended to illustrate a preferred relationship between the length of the links and the pitch of the workpiece;

DESCRIPTION OF THE PREFERRED EMBODIMENTS

Figure 1:
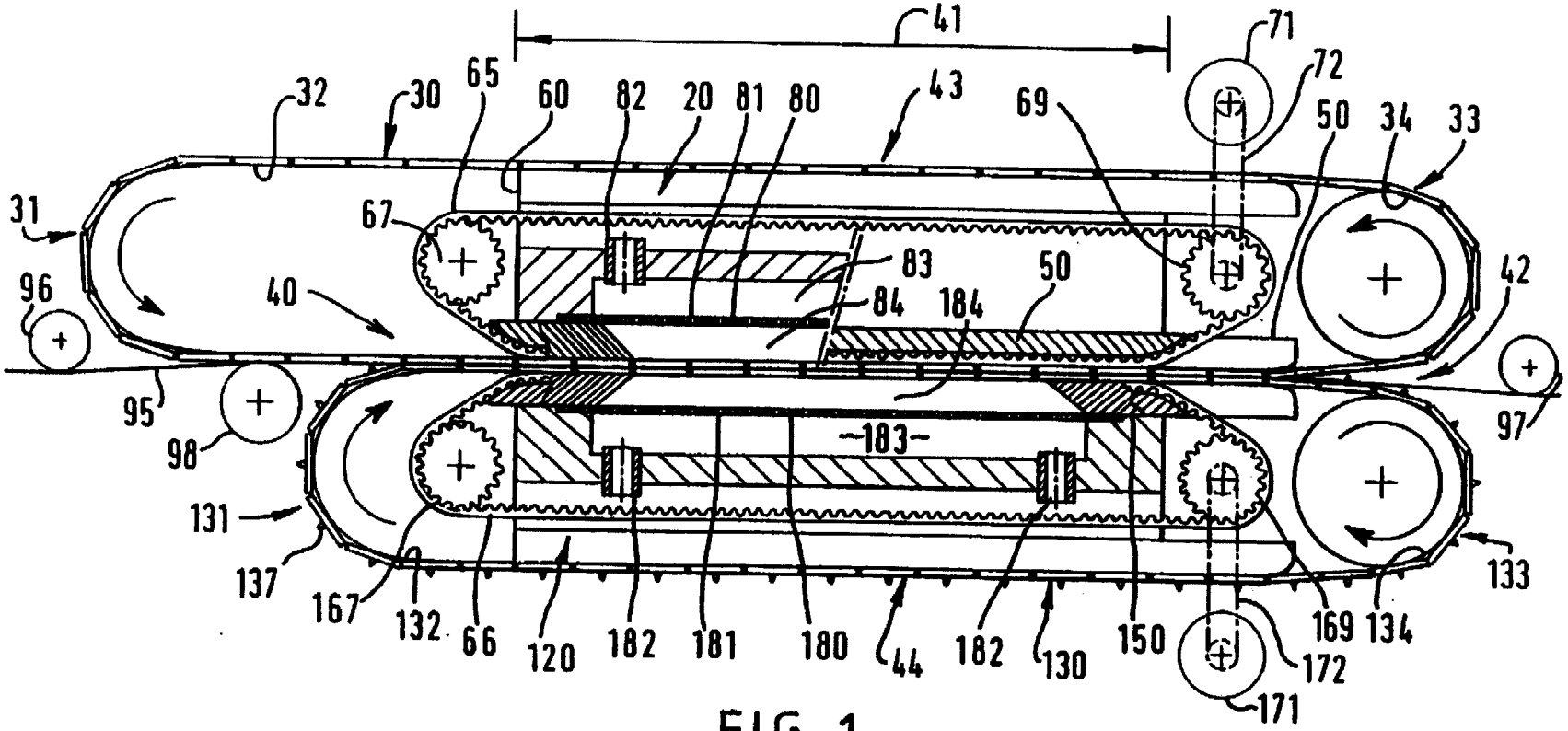
FIG. 1 is a diagrammatic plan view from above in partial section showing a first embodiment of the invention.
Figure 2:
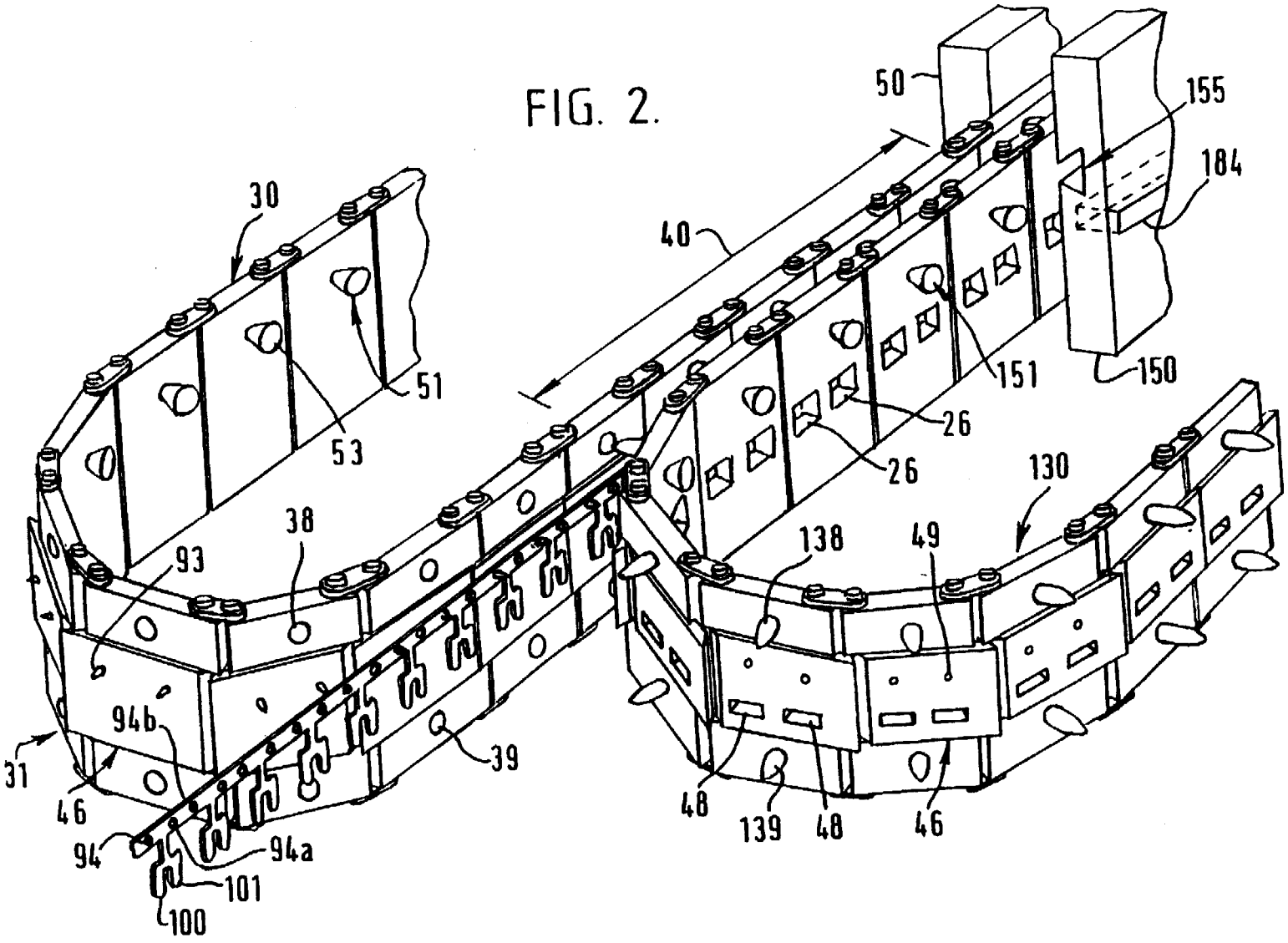
FIG. 2 is a diagrammatic perspective view from above and to one side of the double chain conveyor array shown in FIG. 1 from the inlet end to the plating zone, the left hand end in FIG. 1.
Figure 3:
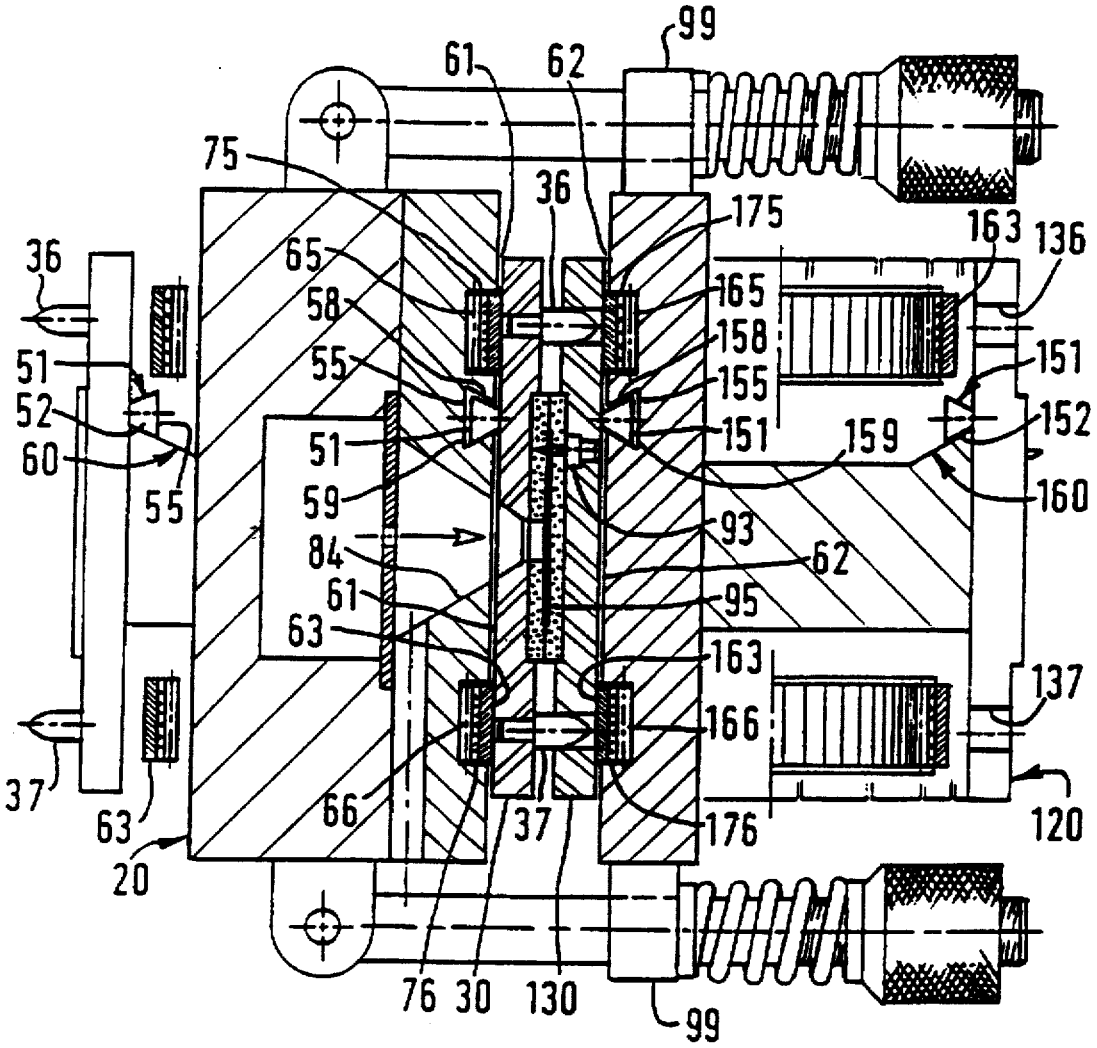
FIG. 3 is a diagrammatic cross section of one form of the embodiment shown in FIG. 1 adapted for plating a spot or a stripe on one side of a workpiece.
Figure 4:
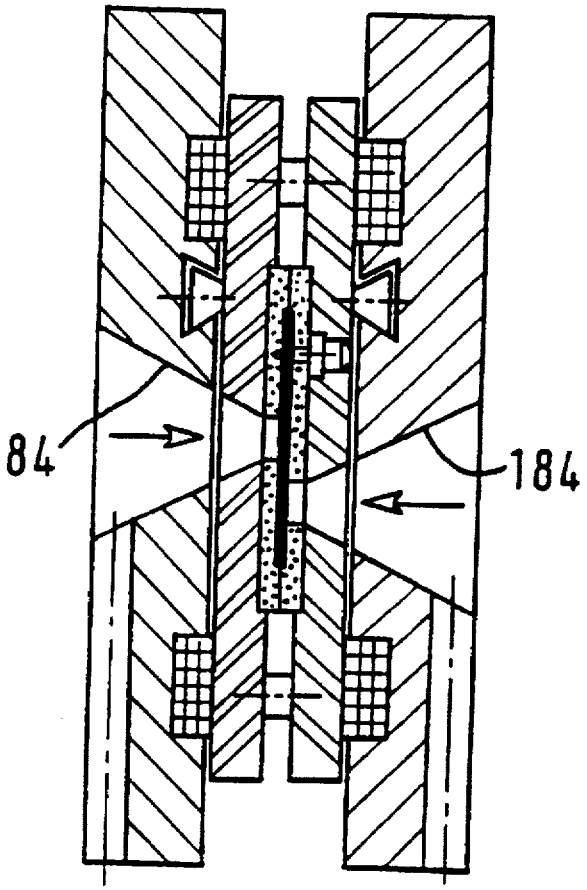
FIG. 4 is a view similar to FIG. 3 showing in more diagrammatic form the central region of the FIG. 3 view and shows a form of the embodiment shown in FIG. 1 adapted for plating a spot or a stripe on both sides of a workpiece simultaneously but at different relative locations out of register with each other.
Figure 5:
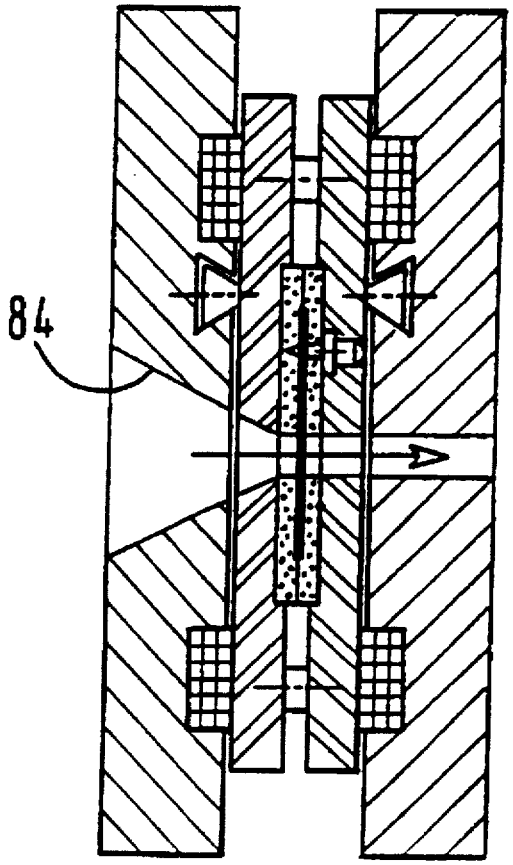
FIG. 5 is a view similar to FIG. 4 and shows a form of the embodiment shown in FIG. 1 adapted for plating both sides and the edge of a contact e.g. an SIMM contact.

The cell shown in FIG. 1 and which FIG. 2 also illustrates and three different forms of which are shown in FIGS. 3, 4 and 5 and of which FIG. 6 and 7 give further details is a plating cell which possesses improved flexibility of operation compared to prior art selective electroplating cells. The cell of the present invention enables selected regions of a workpiece to be plated, whilst the remainder is left free of the electroplated deposit. The selected regions may be stripes or localized regions such as spots of a wide range of desired shapes or may be the edges of workpieces.

The embodiment can accommodate variations in linearity of the workpiece along the workpiece. It also enables workpieces, which are not planar transversely to be handled.

Figure 10:
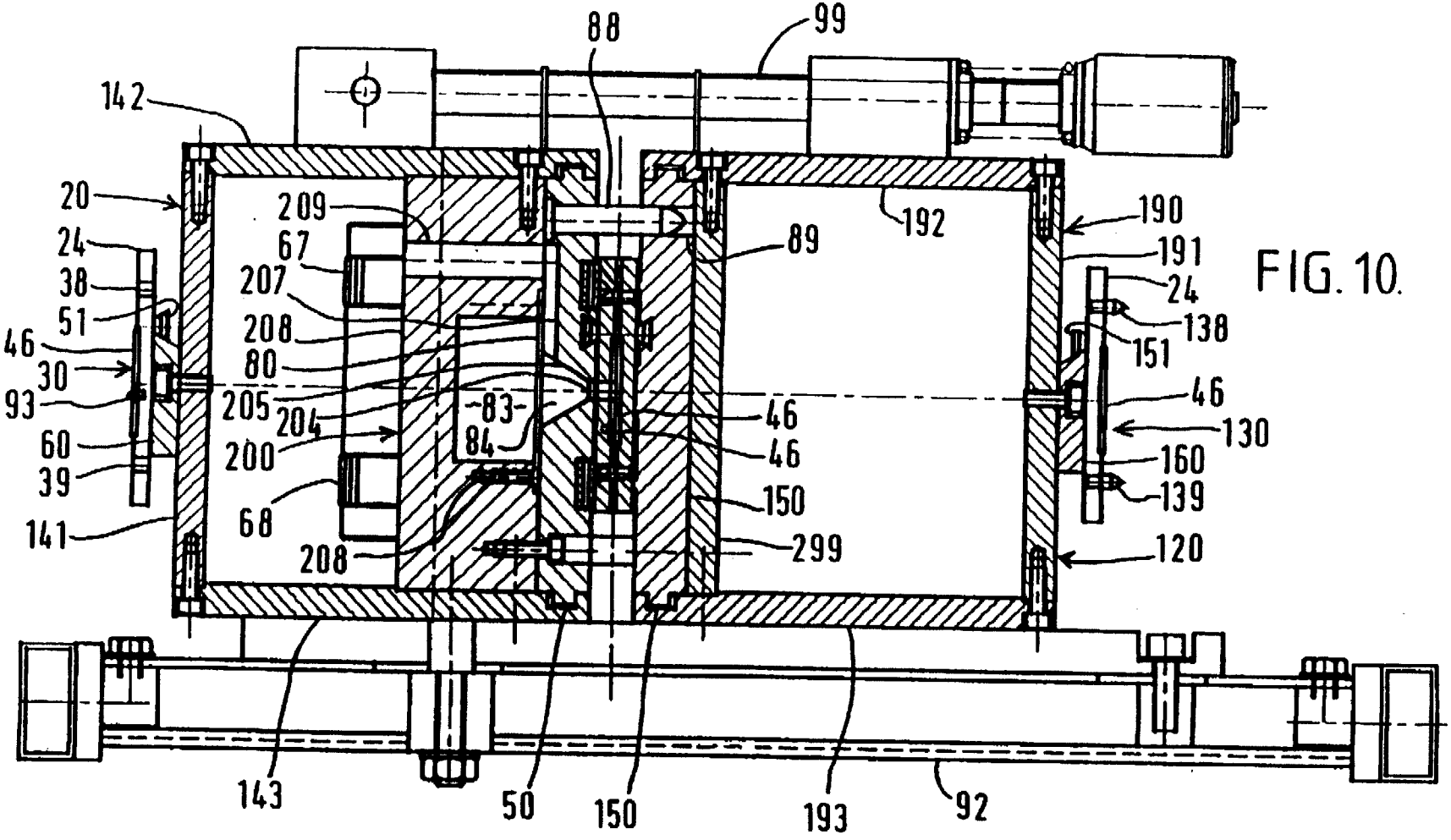
FIG. 10 is a diagrammatic cross sectional view through the second embodiment shown in FIG. 8 of an arrangement similar to FIG. 3.
Figure 11:
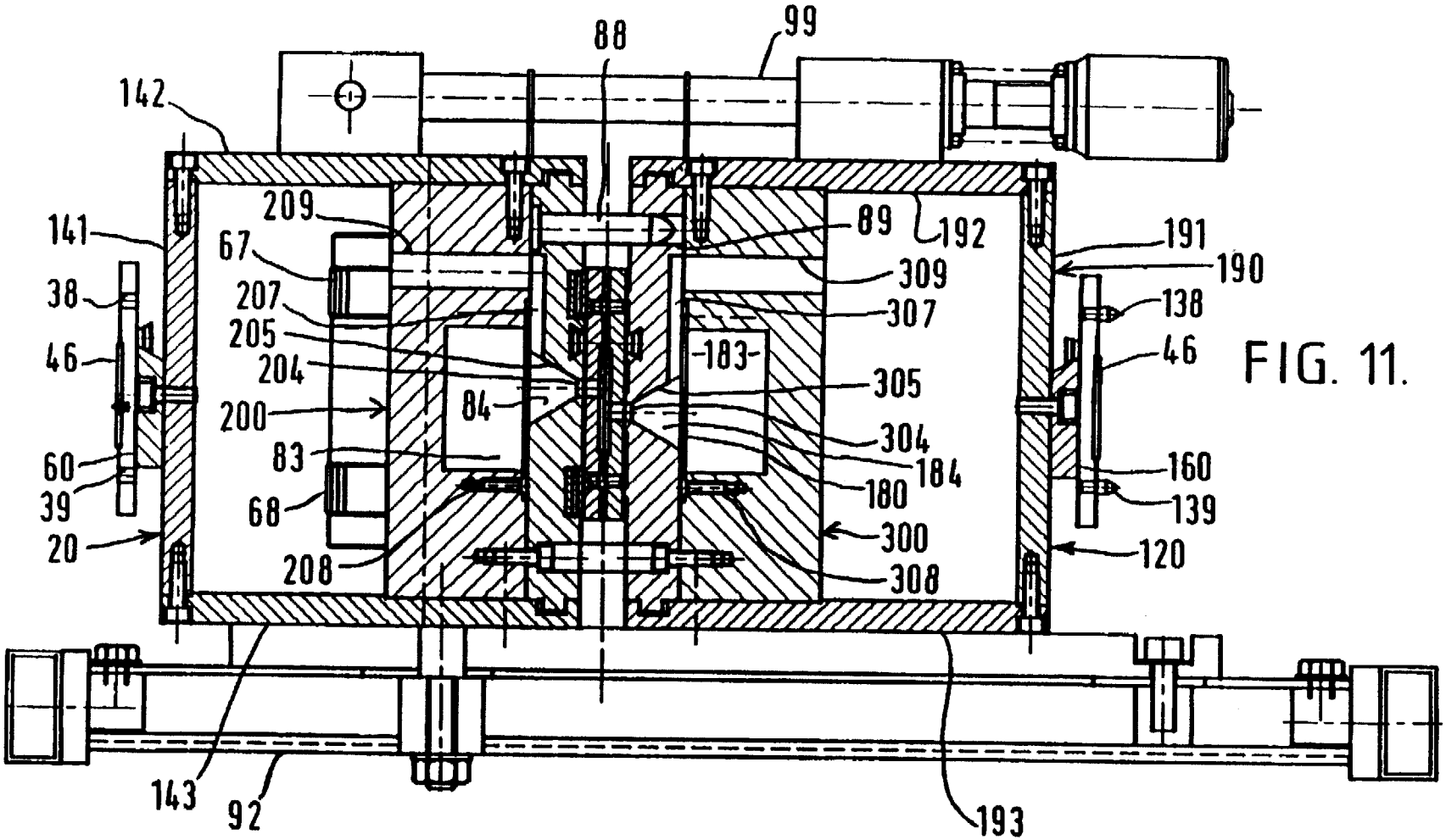
FIG. 11 is a view similar to FIG. 10 of an arrangement similar to FIG. 4.
Figure 12:
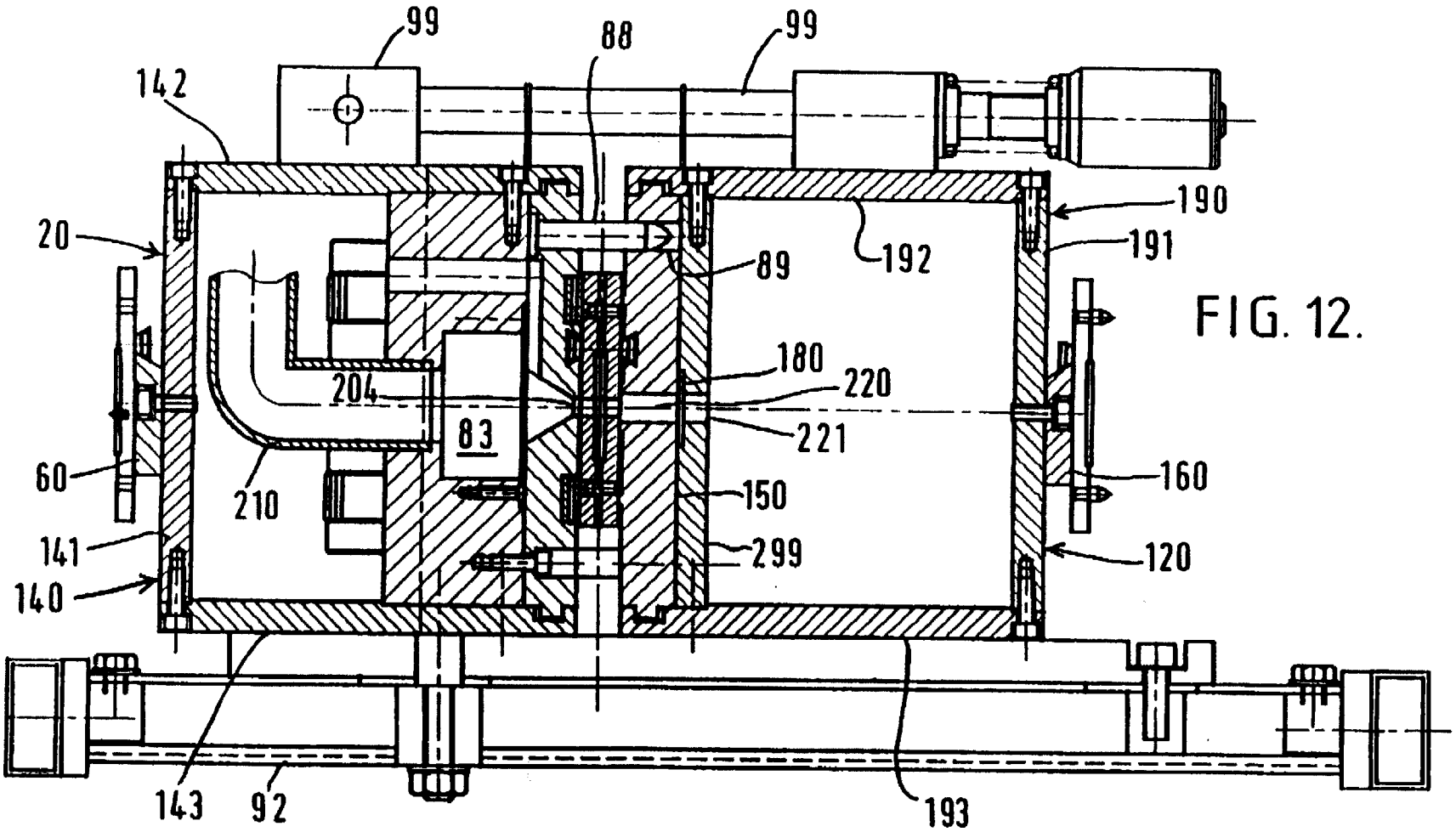
FIG. 12 is a view similar to FIG. 10 of an arrangement similar to FIG. 5.

Compared with prior structures the present invention provides greatly increased manufacturing flexibility. Thus with only minor modifications the apparatus of the present invention can carry out the following operations:

(1) plate one side of a workpiece, e.g. a strip (by feeding electrolyte to only one face) (see FIGS. 3 and 10);

(2) plate both sides simultaneously at the same location (by having the openings in the chain in register with the openings in the other conveyor and feeding electrolyte to both faces simultaneously);

(3) plate both sides simultaneously at different locations (by having the openings in the chain out of register with the openings in the other chain and feeding electrolyte to both faces of the workpiece simultaneously) (see FIGS. 4 and 11);

(4) plate an edge of a workpiece e.g. a strip (by locating the edge in register with the openings in both chains which are themselves in register and feeding electrolyte to the said edge preferably from one side only, (see FIGS. 5 and 12);

(5) plate opposite sides or opposite edges with different plating materials (by placing two apparatuses in accordance with the present invention in line with appropriate rinsing means between them and plating one material onto one face or edge in the first apparatus and a different material or different amount of the same material onto the other face or edge in the second apparatus without having to reorientate the strip between the two stages).

The first embodiment consists of two modules or cassettes, namely a fixed cassette 20 and a movable cassette 120. Each cassette provides a vertically disposed endless chain (30 and 130) of links, the links being hinged to each other in such a way as to allow relative movement within predetermined limits.

The chains provide a conveying and masking function for a workpiece 95. The chains pass through a workpiece indexing zone 40, in which the workpiece 95 is brought into indexed relationship with the belt 30 of the fixed cassette 20 and the belt 130 of the movable cassette 120, a plating zone 41, in which the belts are juxtaposed to each other and pressed together, a workpiece release zone 42, and return runs 43 and 44 respectively. The extent of the plating zone is indicated by the line 41 in FIG. 1.

The endless chain 30 is supported at an inlet end 31 by a curved guide surface 32 and at the outlet end 33 by a freely rotating guide wheel 34 (which can be replaced by a guide surface).

The chain 30 is supported between the guides 32 and 34 by vertically disposed longitudinally extending first and second support structures 50 and 60; the structure 50 is in the plating zone and extends there beyond to the release zone 42 and the structure 60 is in the return zone and extends the same distance as the support 50.

The chain 130 is supported in similar manner by first and second support structures 150 and 160 having the same structures as the supports 50 and 60.

A preferred mode of such support is indicated in FIG. 2 in which the inlet ends of the supports 50 and 150 are shown. The inner faces of the endless chains 30 and 130 are provided with formations adapted to engage in keying freely sliding relationship with cooperating formations provided by the supports 50 and 150.

As shown in FIGS. 2, 3, 4 and 5 these cooperating structures are preferably protuberances 51, 151 on the inner faces of the endless chains which key with recesses 55 and 155 in the chain contacting faces of the supports 50 and 150. (155 is shown in FIG. 2, 58 in FIG. 3, 4 and 5).

This ensures that the chains at least in the plating zone are held to the support structures whilst being free to slide there along.

The protuberances 51 and 151 preferably extend out from the inner faces of the chains in a conical form having conical bearing surfaces 52, 152 (typically inclined at about 20° to 40° e.g. 30° to a perpendicular to the plane of the chain) and terminating in a flat top 53, 153 parallel to the plane of the chain. The recesses 55 and 155 are of matching but slightly wider shape and deeper so that when a protuberance rests in a recess under gravity there is a significant clearance 58, 158 above the protuberance and a significant clearance 59, 159 between the ends 55, 155 of the protuberance and the flat inner faces 57, 157 of the recesses 55 and 155. These clearances are important to allow play between the chains and the supports so that the apparatus can accommodate non linearities such as bowing in a vertical plane of the workpiece (accommodated by the clearance 158) without jamming. The clearance 159 permits the apparatus to handle workpieces which have a camber or are curved transverse to their length.

In the first embodiment the chains 30 and 130 in both cassettes are driven by keyed driving belts having chain contacting surfaces which have an element of compressibility and a high coefficient of friction with regard to the material of the chains so that the belts can drive the chains by frictional contact. The belts pull the chains through the plating zone and this has important consequences regarding accommodation of stamping tolerances which are discussed below in detail with regard to FIG. 7.

The keyed belts are arranged in pairs 65 and 66 in the fixed cassette 20 and 165 and 166 in the movable cassette 120.

The belts 65 and 66 run around upper and lower toothed sprockets 67, 68 at the inlet end 31 and 69, 70 at the outlet end 33. The spocket 69 is driven anticlockwise by a variable speed motor 71 mounted outboard of the cassette via a belt 72; (the sprocket 169 clockwise by a motor 171 and belt 172). The belts 65 and 66 are located in longitudinally extending slots 75 and 76 (see FIGS. 2, 4 and 5) adjacent the edges of the chain 30 and outboard of the support mechanism 51 and any electrolyte supply means, i.e. the belt 65 engages the upper region of the chain and the belt 66 engages the lower region of the chain.

The arrangement and drive of the belts 165 and 166 is the same.

As can be seen in FIGS. 3, 4 and 5 the chain contacting surface of the belts 65, 66, 165, 166 are slightly proud or above the surface of the support structures 50 and 150 so that small clearances 61 and 62 are left between the inner surfaces of the chains and the surfaces of the said supports. The compressible surface layers 63 and 163 of the belts 65, 66 and 165, 166 respectively (see FIGS. 3, 4 and 5) are preferably a hard grade.

Electroplating is achieved by making the workpiece which is conductive (e.g. being metallic or metallized) the cathode. This is achieved by contacting it with cathode pickups 96 at the inlet end and 97 at the outlet end. The workpiece is led to and pressed against the chain 30 of the fixed cassette 20 by an idler roller 98.

In the arrangement shown in FIG. 1 electrolyte is supplied simultaneously to both faces of the workpiece 95 via perforated or mesh anodes 80 and 180, the perforations being shown as 81 and 181. Pump mechanisms (not shown) outboard of the cassettes force electrolyte under appropriate flow rates and pressures into manifolds 83, 183 via inlets 82, 182 through the anodes and into delivery slots 84,184 in the support structures 50 and 150 (see also FIGS. 3, 4 and 5; though these show slightly different arrangements they show preferred shapes of the slots 84 and 184; the slot 184 is also shown diagrammatically in FIG. 2).

The electrolyte impinges on the chains and passes through openings therein to impinge on the workpiece 95 carried between the chains and indexed thereto and metal species from the electrolyte are deposited at selected sites defined by the openings in the chain. The spent electrolyte then passes to drain or recovery. How this can be done is shown in FIGS. 10, 11 and 12 which are described below.

Referring now specifically to FIG. 2 it should be appreciated that this is highly diagramaticaly and, for clarity in showing the workpiece and chain indexing functions, chain support functions and electrolyte delivery functions, omits the chain driving mechanism. The chain driving mechanism is shown generally in FIG. 1 and also in FIGS. 3, 4, 5 and 6.

Indexing is an important feature of the present invention and the indexing aspects will now be described in detail.

First of all the cassettes are indexed to each other by cooperating mechanisms e.g. pins 88 and holes 89 for example pins 88 located in the fixed cassette 20 locating in holes 89 in the movable cassette 120 (see FIG. 10, 11 and 12). These pins and holes are located outboard e.g. above or below the chains 30 and 130 so as not to interfere with their free movement. The movable cassette 120 rests slidably on transverse bars 91, 92 (see FIGS. 8A and 8B) to which the fixed cassette is secured. Once the pins 88 have been engaged in the holes 89 the movable cassette can be secured to the fixed cassette by spring loaded adjustable pressure clamps 99 preferably located above and below the cassettes (see FIG. 3).

Secondly the two chains are indexed to each other by cooperating mechanisms e.g. pins 36, 37 in the chain 30 and holes 136, 137 in the chain 130 (see FIG. 3) or in the reverse sense by pins 138, 139 in the belt 130 and holes 38, 39 in the chain 30 (see FIGS. 1 and 2).

Thirdly the workpiece 95 is indexed by pins 93 in the belt 30 engaging indexing holes 94 in the workpiece 95 and holes 49 in the belt 130.

The electrolyte delivery function has been described so far up to the stage when the electrolyte is delivered to the inner face of the chains.

The chains are formed of links 24 of non-conducting resin desirably of low thermal coefficient of expansion. The links 24 are the same in each chain 30 and 130.

FIGS. 1 and 2 show a multitude of links in straight line configuration and which are articulated to each other as they pass round the inlet 31 and outlet 33. FIG. 6 shows three individual links 24*a*, 24*b* and 24*c*.

As described above the electrolyte is pumped via the manifolds 83, 183 through the perforations 81, 181 in the anodes 80, 180 and gains access to the workpiece 95 via openings 26 in the links 24.

The openings 26 help to define the areas or zones of the workpiece 95 which it is wished to plate. The workpiece 95 may be a strip which may be metal or have a metallized surface or surfaces. The strip 95 specifically shown in FIG. 2 has contact legs 100, 101 and in FIG. 2 the ends of these legs will register with the openings 26 in the links and thus be plated on one face. As can be seen in FIG. 2 each link 24 has two such openings 26 so that it can plate adjacent pairs of contact legs.

Referring again to FIG. 6 (and also to FIG. 2) the workpiece contacting faces are provided with sealing plates 46 of compressible insulating material e.g. silicone rubber (softer (more compressible) that the surfaces 93 of the keyed belts 65, 66, 165, 166).

The links 24 carry a longitudinally extending recess 27 in their face 28 which in use is disposed towards the workpiece 95. The openings 26 extend through this recess 27 and the recess extends a substantial distance towards the edges of the link beyond the edges of opening 26.

The sealing plates 46 are arranged to be a close fit in the recess 27 and have an opening 48 which defines the area of the workpiece which is to be plated. The plates 46 are also provided with guide holes 49 the locations of which relative to the openings 48 are such that whilst the openings 48 are in register with the openings 26 each plate 46 extends across the joint between adjacent links e.g. 24*a* and 24*b* (see FIG. 6).

The planes 46 are preferably made of elastomeric material resistant to the plating conditions, are desirably compressible so as to ensure a good seal e.g. by being squeezed outwardly against the side walls of the recess 27 and longitudinally against their abutting ends. The masks 46 are preferably also flexible so as not to interfere with the passage of the links around the ends of the endless chains. The plates 46 are secured to the links 24 with a suitable adhesive.

The guide holes 49 are sized to receive the indexing pins 93 located in the links 24 which register in the indexing holes 94 of the workpiece 95.

Figure 16:
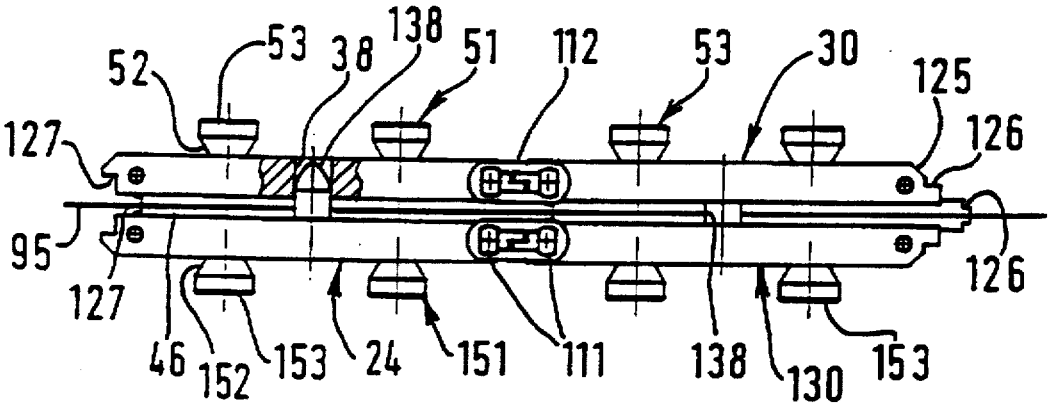
FIG. 16 is an elevation from the top of a pair of links of a conveyor chain in accordance with the present invention being a modification of the arrangement shown in FIG. 6, and appropriate for use in the arrangement of FIG. 12.

It will be observed that the ends of the plates 46 are chamfered at 125 so as to overlie each other and help provide a seal. Such sealing can be enhanced by forming the ends of the links 24 with matching overlapping configurations e.g. male and female at either end e.g. stepped protuberances at one end and matching stepped recesses at the other end. Such configurations can also be used on the masking plates. FIG. 16 shows one such configuration.

Referring again to FIGS. 6 and 7 it will be observed that the links 24*a*, 24*b*, 24*c* are interconnected by loose attachments 110 constructed in such a way that the distance between the links can vary axially according to the position which they occupy on the moving chains 30, 130. In fact, due to the elements of these attachments, namely nails or studs (called "pins" 111 here), fixed in the links 24 and cooperating, as shown in the drawings (FIG. 6) with an elongated loop 112 in such a way that a bearing surface 113 of the said pins 111 can slide freely in the eye of the loop 112, the links 24, (24*a*, 24*b* and 24*c*) can either be in contact with one another (see the links 24*a* and 24*b*) or can be separated from one another (see the links 24*b* and 24*c*) in such a way as to acquire a sufficient angular mobility to circulate on the returns of the chain. It will be noted that in order further to improve this mobility, the axial faces of the links 24 can be chamfered (see FIG. 6); however, this particular feature of construction is not essential. The pins 111 can be driven into the material of the links 24. The links 24 are preferably made of an electrically insulating polymer resin. However, it will be noted again that in the construction shown in FIG. 6 the head 114 of the pins 111 cannon be oriented indiscriminately because it has a particular shape, namely it is not circular but has flat parts 115 directed at right angles to the links, the spacing of which corresponds no the diameter of the bearing surface 111. Due to this arrangement the chain can be easily removed; in fact, it is sufficient, once the chain has been placed on a flat surface to turn over one of the links on the following one (or the preceding one) so that the flat parts 113 of the pins 1! 1 are oriented as an extension of one another and it is then possible for the loop 112 to be freely withdrawn. However, this shape is optional and the studs 111 could have a circular or polygonal head, in which case they could be screwed into the material of the links, the part 116 of the studs being threaded.

The length "L" (see FIG. 6) of the links of the chain used in the electrolytic cell of the present invention is determined as a function of the pitch "A" (see FIG. 7) of the workpiece to be plated. The pitch of the workpiece is defined as being the distance separating two respective patterns of the latter.

Referring to FIG. 2 it will be observed that the repeat pattern occurs every other guide hole 94. Thus the pitch "A" of the workpiece shown in FIG. 2 is from the guide hole 94 to the guide hole **94*b* i.e. twice the distance between the centres of adjacent guide holes 94**.

A portion of such a workpiece 95 is shown schematically in FIG. 7, as well as two of the holes 94 and **94*b* for positioning this workpiece with respect to the pins 93 carried by the links 24 of the plating chain 30. The pitch of the strip is designated by "A" and the radius of the guide pins 93 by "$R_2$". The length of the links 24 desirably has a value between "A" minus "$R_2$" and "A" minus "X" where "X" designated the tolerance, plus or minus, over the length "A" when the workpiece was made e.g. stamped. FIG. 7 shows a pin 93 in which the shank having a radius "$R_2$" has a dimension slightly less than the diameter "$2R_1$" of the hole 94 or 94*b* and the point 93*a* of the pin 93 has a diameter "$2R_3$" normally less than one tenth of that "$2R_2$" of the shank of the pin 93. Thus with reference to FIG. 7 provided that the errors in the pitch "A" of the workpiece (tolerance "X") do not exceed a value corresponding to the difference in diameter 2 ($R_1$–$R_2$) between the shank of the pins 93 and the holes 94 and 94*b* and if the length "L" of the links remains between A–$R_1$ and A–X and, at the moment of the engagement of the pins in the holes, adjacent links 24 are fully extended away from each other, the point 93*a* of the pin 93 is directed towards the centre of the circle formed by the hole 94 and 94*b*. Thus the engagement of the links with respect to the workpiece 95** can be carried out readily.

It will be recalled that the chains 30 and 130 of links 24 hingedly, connected by extendible links 112 are pulled in the plating zone 41. This means that the axial play "P" between adjacent links e.g. **24*a* and 24*b* needs to be at least as much as the total tolerance of "X" (the most extreme tolerance which will be encountered) in the distance separating adjacent guide holes e.g. 94 and 94*b* in the workpiece but should not exceed the diameter ($2R_2$) of the pin 93 (where $R_2$ is the radius of the pins 93**) minus the Total tolerance.

Thus the following relationship preferably applies:

X is less than or equal to P which is less than or equal to ($2R_2$–X).

The length "L" of a masking links 24 is preferably defined by the following relationship:

A–$R_2$ is less than or equal to L which is less than or equal to A–X.

In practice with holes 93 of 1.5 mm in diameter ($R_1$–750 micrometers) and pins 93 of which the shank has a diameter $R_2$ or 1.4 mm and the tip **93*a* a diameter $R_3$ of 10–20 micrometers, an error ("X") of 50 micrometers on either side of the mean pitch "A" will be easily accommodated. Since the usual total stamping tolerance does not generally exceed about 20 micrometers over a distance of 10–30 mm, it will be seen that the apparatus can readily accommodate stamping tolerances to efficiently position the mask links 24 with respect to the parts of the workpiece 95** which are to be plated.

Reference has been made above to the return runs 43 and 44 and the support structures 60 and 160 (see FIG. 1). These can be seen in more detail in FIG. 3. As can be seen each of these structures is in essence an upwardly facing inclined shelf, hook or rail on which the protuberances 51 and 151 rest and along which they freely slide during the return run. It is desirable that this free running is maintained and that adjacent links 24 of the chains remain separated from each other in the return run. The embodiment shown in FIG. 8B helps to maintain this condition. The outlet guides or wheels 34 and 134 are biased outwardly towards the outlet end 33, e.g. spring biased for example by helical torsion springs 77 and 177, positioned vertically and having their ends 78, 178 located in arcuate slots 79, 179. This arrangement also helps take up any thermal expansion within the total structure.

The second embodiment shown in FIGS. 8 to 12 differs from the first embodiment in some ways but like parts will be designated by the same reference numerals. In particular the second embodiment is arranged in a different sense, the inlet end being at the right hand side rather than the left hand side. In addition the chains are driven by one motor 71 driving the chain 30 in the fixed cassette 20 (for clarity the chain is largely omitted from FIGS. 8A and 8B only a small portion being shown in FIG. 8A). The chain 30 being keyed to the chain 130 also drives it. This arrangement is simpler and has been found to give excellent mechanical operation.

Figure 8A:
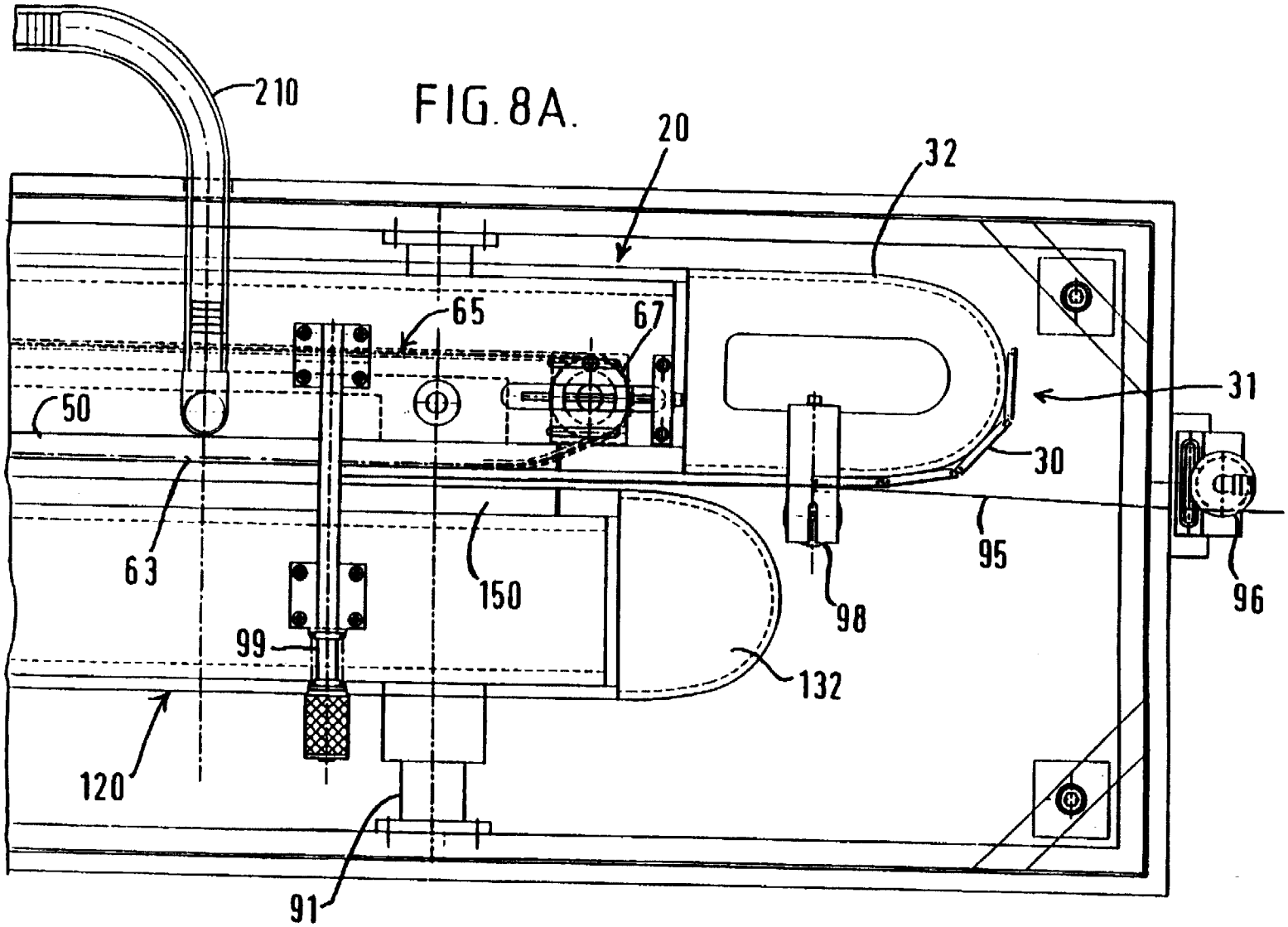
FIGS. 8A and 8B are views similar to FIG. 1 of a second embodiment of the present invention which differs from the first in than only one of the chains is directly driven, FIG. 8A showing the input end.
Figure 8B:
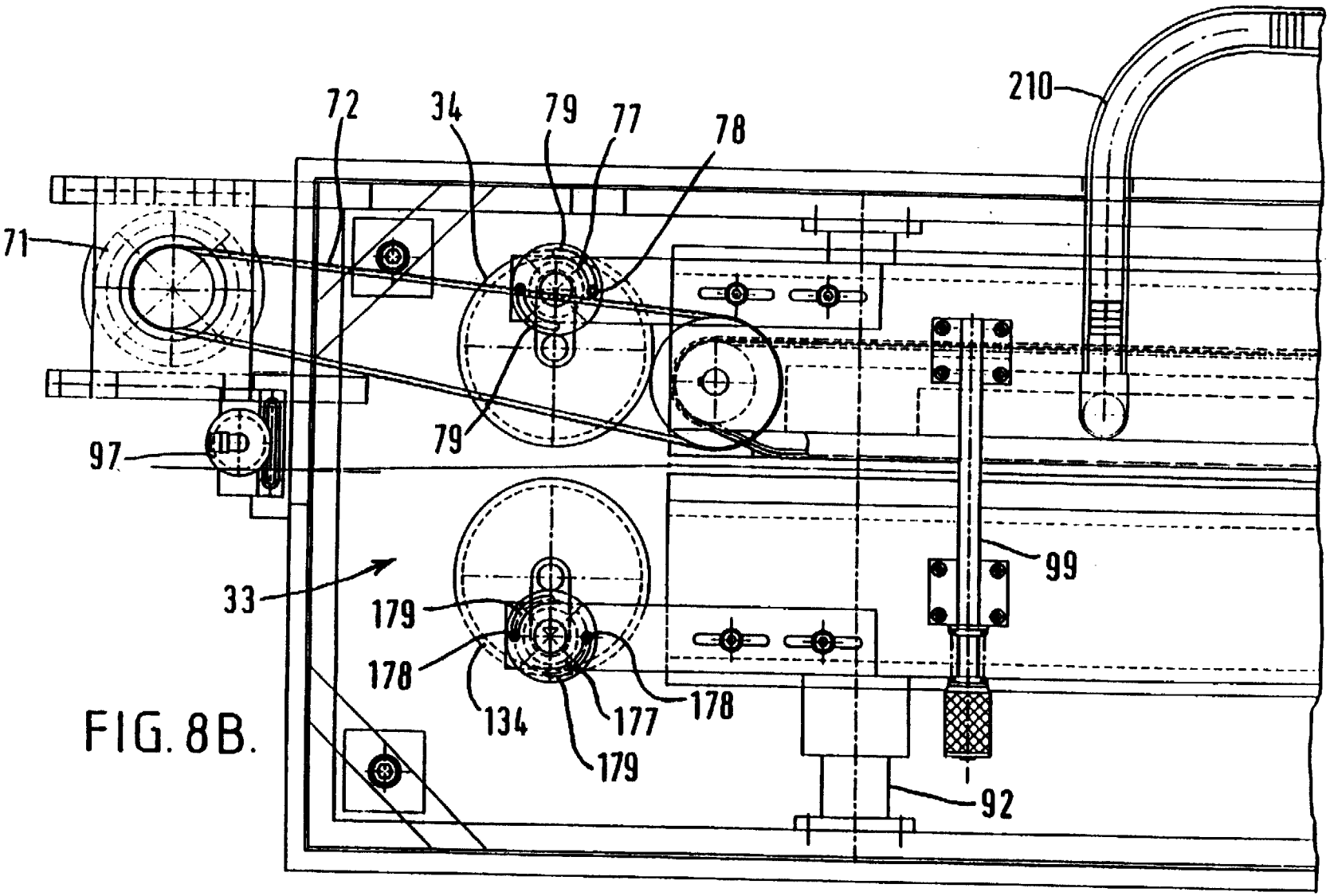
Figure 9A:
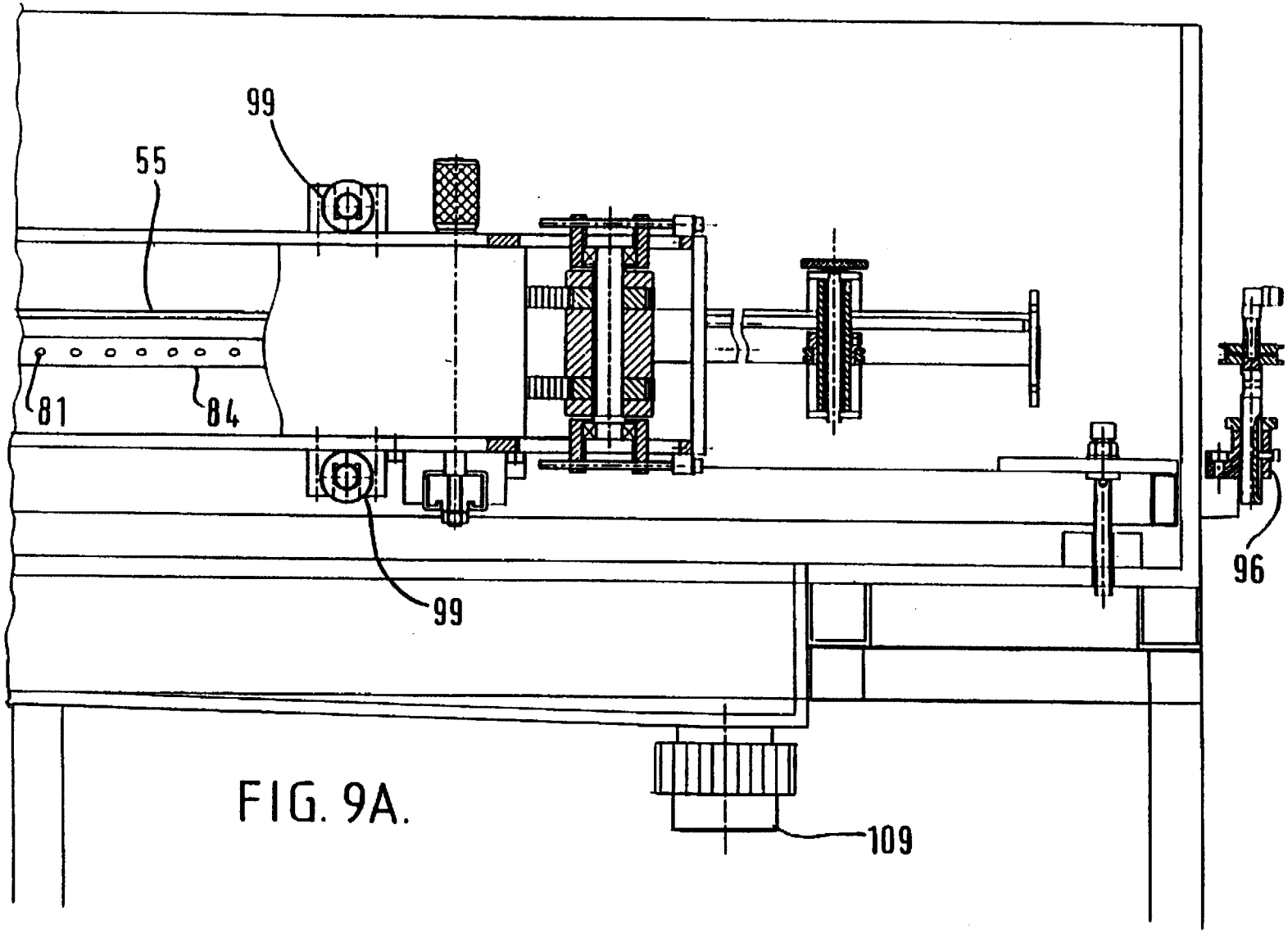
FIGS. 9A and 9B are diagrammatic side elevations of one of the chains of the embodiment shown in FIGS. 8A and 8B, FIG. 9A showing the input end.
Figure 9B:
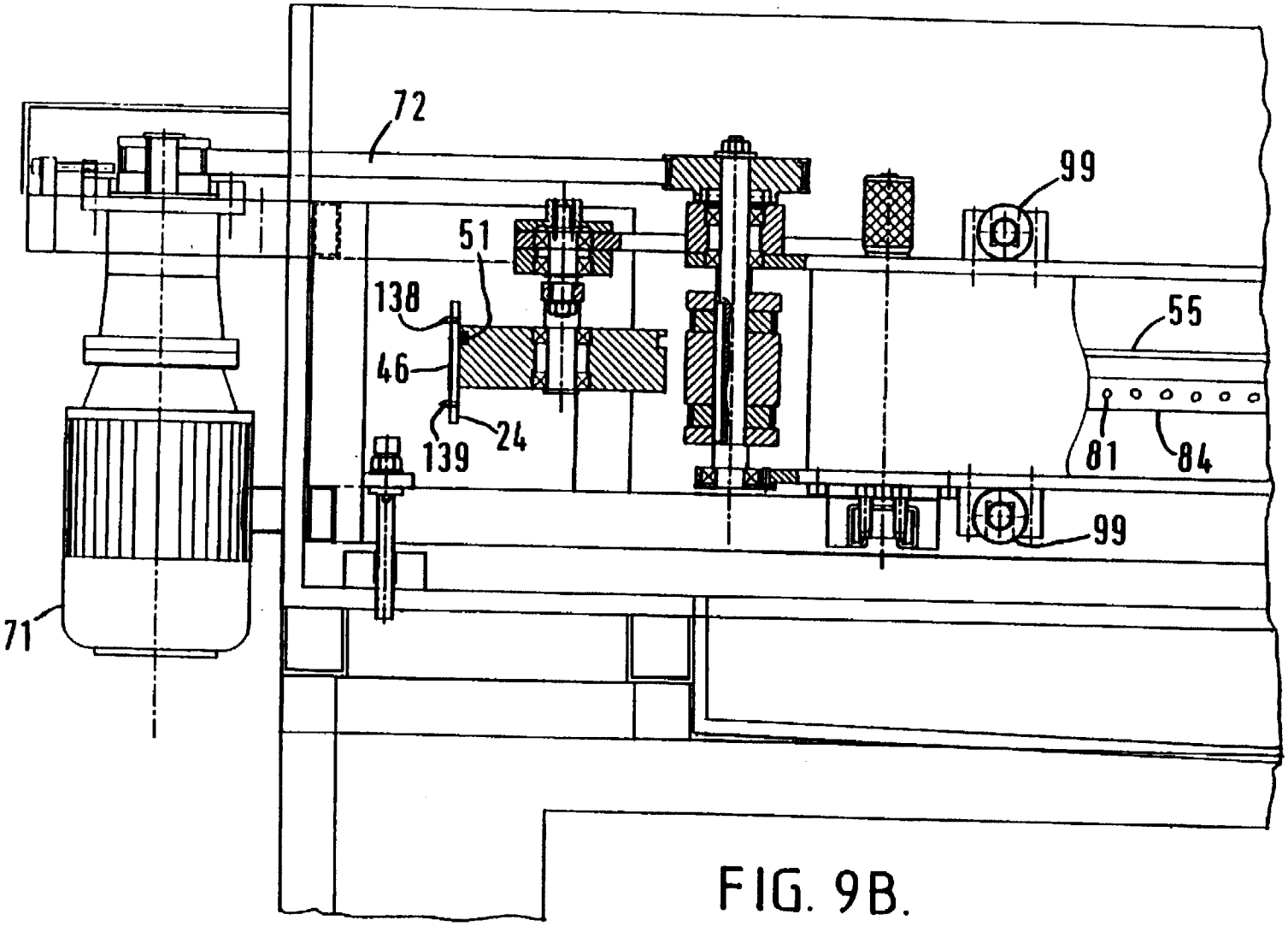

FIG. 8A shows the inlet end of the apparatus with the workpiece 95 passing over the cathode contact 96 and then being pressed against the chain 30 of the fixed cassette 20 by the idler roller 98. The fixed cassette 20 is mounted on transverse bars 91 and 92 (FIG. 8B). The movable cassette 120 is also mounted on the bars 91 and 92 but is not secured thereto; it can be slid away from the cassette 20 and lifted off the bars. It is indexed to the cassette 20 by pins 88 on the cassette 20 and holes 89 on the cassette 120 (see FIGS. 10–12). Once these are in register so as to index the two cassettes to each other the movable cassette 120 can be clamped to the cassette 20 by the spring loaded clamps 99. The apparatus is then ready for use.

Referring specifically to FIGS. 10, 11 and 12 each cassette 20 consists of a housing having a rear wall 141, a top wall 142 and a bottom wall 143; the cassette 120 has a rear wall 191, a top wall 192 and a bottom wall 193. The upper clamp 99 is mounted on the top wall 142 and engages structures on the wall 193. The rear wall 141 carries the return support structure 60 for the belt 30 and the rear wall 191 carries the return support structure 160 for the belt 130.

The bottom walls 143 and 193 provide holes 109 (see FIG. 9A) for draining spent electrolyte from the cassettes for discharge or reuse.

The front wall of the fixed cassette in each of the FIG. 10, 11 and 12 embodiments is provided by the first support structure 50 which carries the cassette indexing pins 88, slots 75 and 76, in which the drive belts 65 and 66 run, the recess 55 for supporting the chain 30 and a row of inlet holes 204 instead of the slot 84 of FIG. 1.

Each hole 204 has a conical throat 205 which leads to an upwardly extending hole or groove 207 in the rear face of the support 50. The back of the support 50 is closed by a manifold box 200 affording the manifold 83. The anode 80 is clamped between the back of the support 50 and the manifold box 200 and is provided with electrical supply means 208. The hole or groove 207 communicates with a hole 209 which passes through the wall of the manifold box 200 into the interior of the cassette housing and this permits spent electrolyte to pass out of the cassette via the drain holes 109.

As can be seen in FIG. 12 an electrolyte inlet pipe 210 is provided to supply the manifold 83. The pipe 210 enters the housing 140 through the top wall 141.

The fixed cassette 20 also carries keyed drive wheels 67 and 68 on which are mounted the drive belts 65 and 66 which as described above drive the endless chain 30 around the cassette. The chain 30 is supported on the cassette by its protuberances 51 resting in the recesses 55 in the first support 50 and on the second support 60 (which is mounted on the rear wall 141). The links 24 of the chain 20 have holes 38 and 39. These receive pins 138 and 139 carried by the chain 130 which is thus indexed to and held in register with the belt 30 and thus driven by it.

As described above the chain links 24 each carry plate masks 46 and also workpiece indexing pins 93, which in this case are carried on the chain 30 which is mounted on the fixed cassette 20.

The arrangement of the cassettes which has been described so far applies to all of the embodiments shown in FIGS. 10, 11 and 12.

The differences come in the movable cassette 120.

FIG. 10 shows an arrangement for selectively making deposits on only one side of the workpiece.

In this arrangement the housing 190 of the movable cassette has its front wall closed by a first support structure 150 which merely has a recess 155 for the protuberances 151 of the chain 130. Otherwise the support has no apertures in it. The support 150 is mounted on a plate 299. The links 24 of the chain 130 do not contain openings 26 and the masking plates 46 also do not contain openings. Accordingly only the side of the workpiece 95 which faces the fixed cassettes 20 is treated. In operation electrolyte is projected onto the workpiece via the holes 204, flows over the top surface and then out along the groove 207 and hole 209 and thence to drain, the pressure with which the electrolyte is supplied being sufficient to achieve the circulation.

FIG. 11 shows an arrangement in which both faces of the workpiece 95 are treated at the same time but at locations which are not in register.

The fixed cassette has the same structure as described for FIG. 10. The movable cassette has a housing 190 which has its front wall provided with a structure which is the same as that for the movable cassette except that reference numerals in the 300's are used instead of the 200's, e.g. groove 307 instead of 207. In addition the holes 304 are offset from the holes 204.

FIG. 12 shows an arrangement in which the edges of a workpiece are treated.

In this arrangement the housing 140 is the same as described for FIGS. 10 and 11.

The housing 190 for the movable cassette is the same as for FIG. 10 except than the first support structure 150 has openings 220 in it which are in line with the openings 204 and the anode 180 is located between the support 150 and the plate 299.

The plate 299 has holes in line with the holes 220. The holes 220 and 221 are of the same size and are of greater diameter than the holes 204.

In use electrolyte mostly passes through the holes 204 to the holes 220 and 221 and thus out via the housing 190, but provision is made for venting via the grooves 207 and holes 209 to the housing 140 as well. This can avoid dangerous build up of any gases produced by the electrolyte action. Apart from this the structure of FIG. 12 is the same as for FIGS. 10 and 11.

Figure 13A:
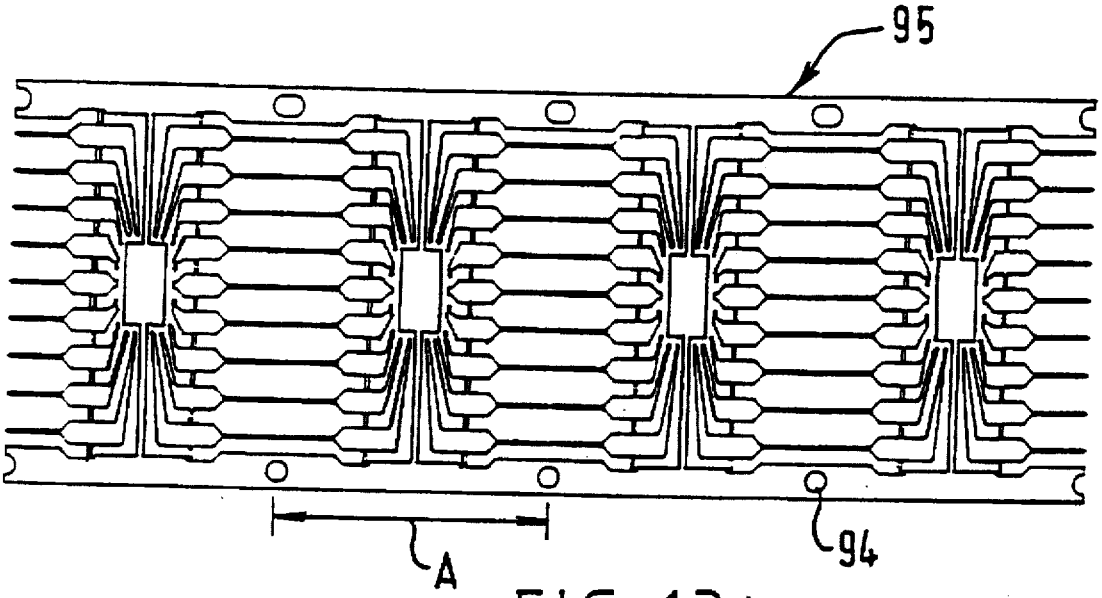
FIG. 13 is a very much enlarged plan view of one form of typical workpiece which one might wish to plate from one side in the central region at the pad and lead frames with the region of the pad and lead frames shown on a yet larger scale below it.
Figure 13B:
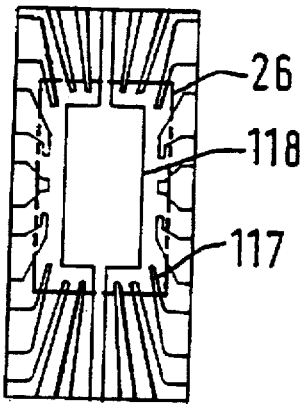

Referring now to FIG. 13 this shows on much enlarged scale a stamped out metal workpiece of which it is wished to plate the pad 118 and the lead frames 117 surrounding it. The pitch "A" is shown as are the guide holes 94 in which the indexing pins 93 will register in use. The openings 26,48 in the links 24 and masking plates 46 are shown by the reference numeral 26.

The arrangement shown in FIG. 10 can be used to plate one side of such a workpiece and the arrangement shown in FIG. 11 to plate both sides out of register.

Figure 14:
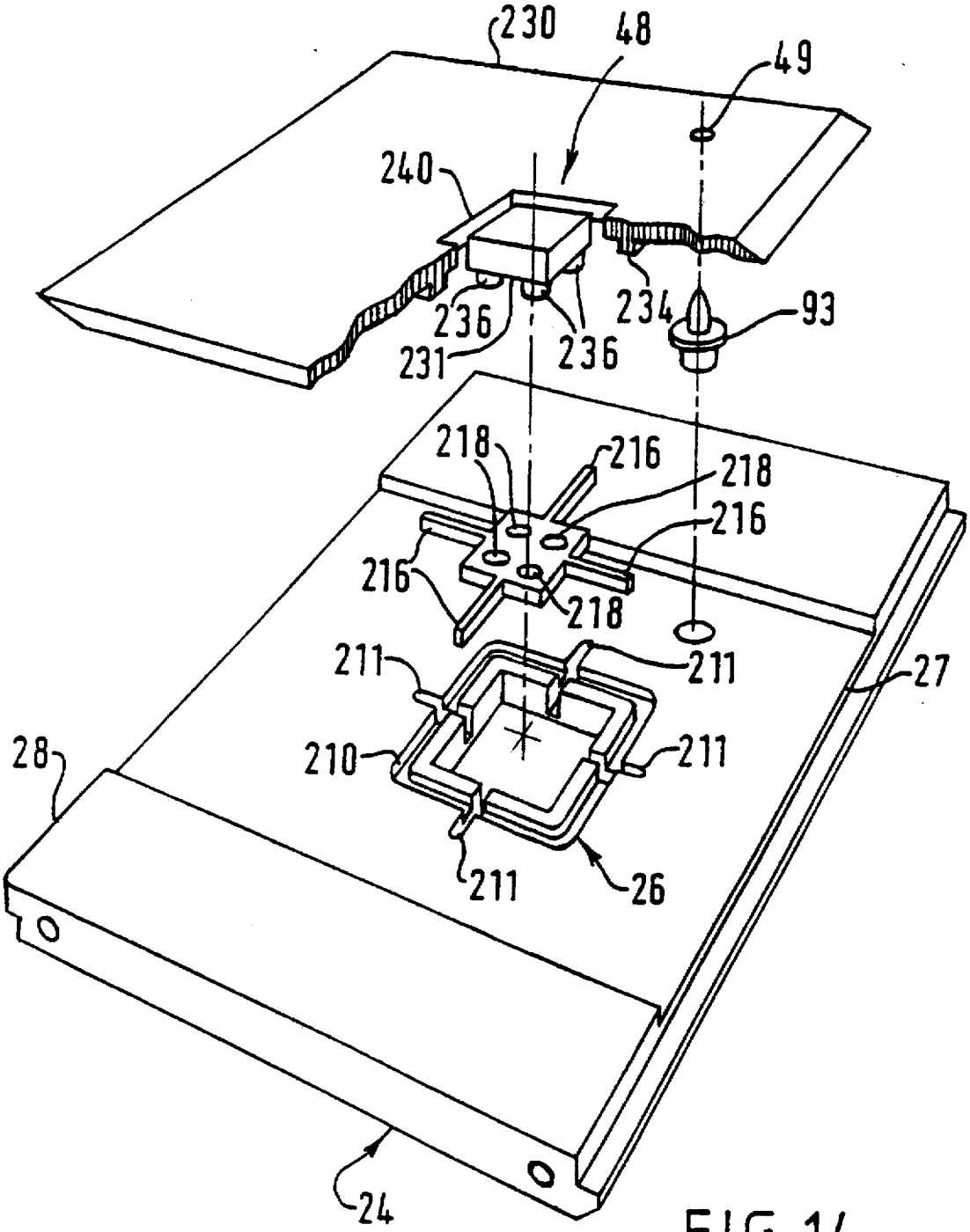
FIG. 14 is exploded perspective view of a link and masking structure which can be used to plate merely the lead frames whilst masking the pad.

FIG. 14 is an exploded perspective view showing how a link and masking plate can be provided so as to enable solely the lead frames 117 to be plated whilst avoiding plating of the pad 118.

FIG. 14 shows a single link 24 having a recess 27 in its face 28 with the opening 26 being of modified form. A masking plate 46 is also shown and this has an opening 49 also of modified form. It will be recalled that the workpiece will be located above the masking plate 46 in operation and the electrolyte will be introduced from below the link 24 (or if the assembly is arranged vertically from the side of the link 24 remote from the plate 46).

The holes 26 and 48 are arranged so as to afford a rectangular 4 portioned slot which will supply electrolyte to the lead frames e.g. 117 in FIG. 13 whilst the pad 118 is masked.

The opening 26 remains of the same size but has a groove 210 formed in the face of the recess 27 surrounding the opening 26. Opposed transverse slots 211 are formed in the face of the recess 27 and extend out from the opening 26 past the groove 210.

An insulating plate 215 is provided with arms 216 located and dimensioned so as to hold the plate 215 flush with the surface of the recess 27 when the arms 216 are located in the two slots 211 and glued therein. The plate also has recesses 218 in one face. The edges 220 of the plate leave slots 225, 226, 227 and 228 between themselves, the arms 216 and the inner edge of the opening 26. Electrolyte passes through these slots.

The masking plate 46 is in two portions, a main portion 230 and a pad masking portion 231. The main portion 230 is the same external dimension as for example in the FIG. 6 embodiment but has a rib 234 adapted to be a close and sealing fit in the groove 210 in the link 24. In use the rib 234 is located in the groove 210. The pad masking portion has four projections 236 adapted to fit into the recesses 218 and secure the pad 231 to the link 24.

Accordingly a rectangular annular electrolyte supply slot 240 is afforded between the two parts of the masking plane and supplies electrolyte merely to the lead frames 117 which are thus plated whilst the pad 118 which is masked by 231 remains unplated.

Figure 15:
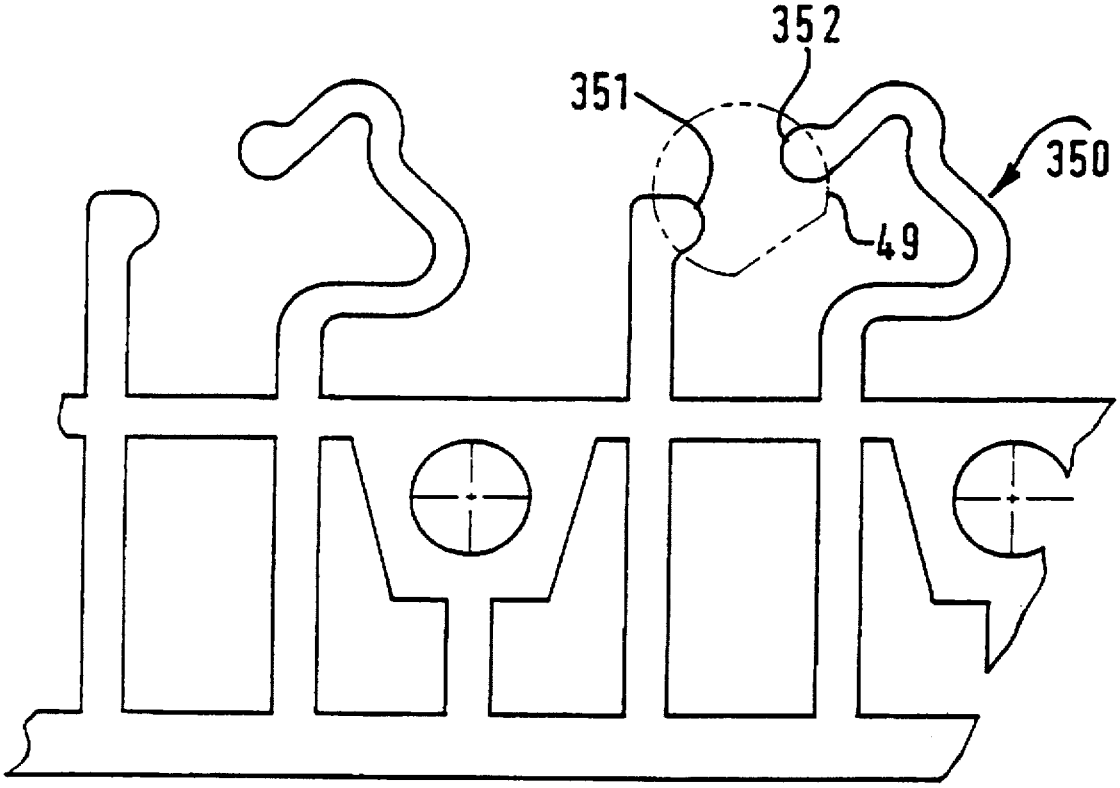
FIG. 15 is a view similar to FIG. 13 of a different typical workpiece where one might wish to edge plate the structures shown at the top with one material and plate both sides of the structures shown at the bottom with a different material.

FIG. 15 is a view similar to FIG. 13 where it is wished merely to plate the tips 351 and 352 of a connector structure 350 without plating the rest of the structure. Superimposed on the drawing is the shape of the hole 49 in the masking plate which it is preferred to use to achieve this plating of the tips.

The arrangement of FIG. 12 can be used to do this and plating of the edges as well as the faces of the tips is achieved with this through-flow array.

FIG. 16 is a side elevation of a pair of links in the conveyor chain located in register with each other with their masking plates 46 also in contact and a workpiece 95 clamped in register therebetween.

The links 24 each have a chamfered end 125 the inner face having cooperative stepped male 126 and female ends 127, thus providing overlap to facilitate sealing whilst the chamfer facilitates the links articulating outwardly away from each other. The connection between the links is as shown in FIG. 6 using the pins 111 and loops 112. The masking planes have the same stepped configuration on a smaller scale and as described above in connection with FIG. 6 are in staggered relationship to the joints between adjacent links 24.

Figure 17:
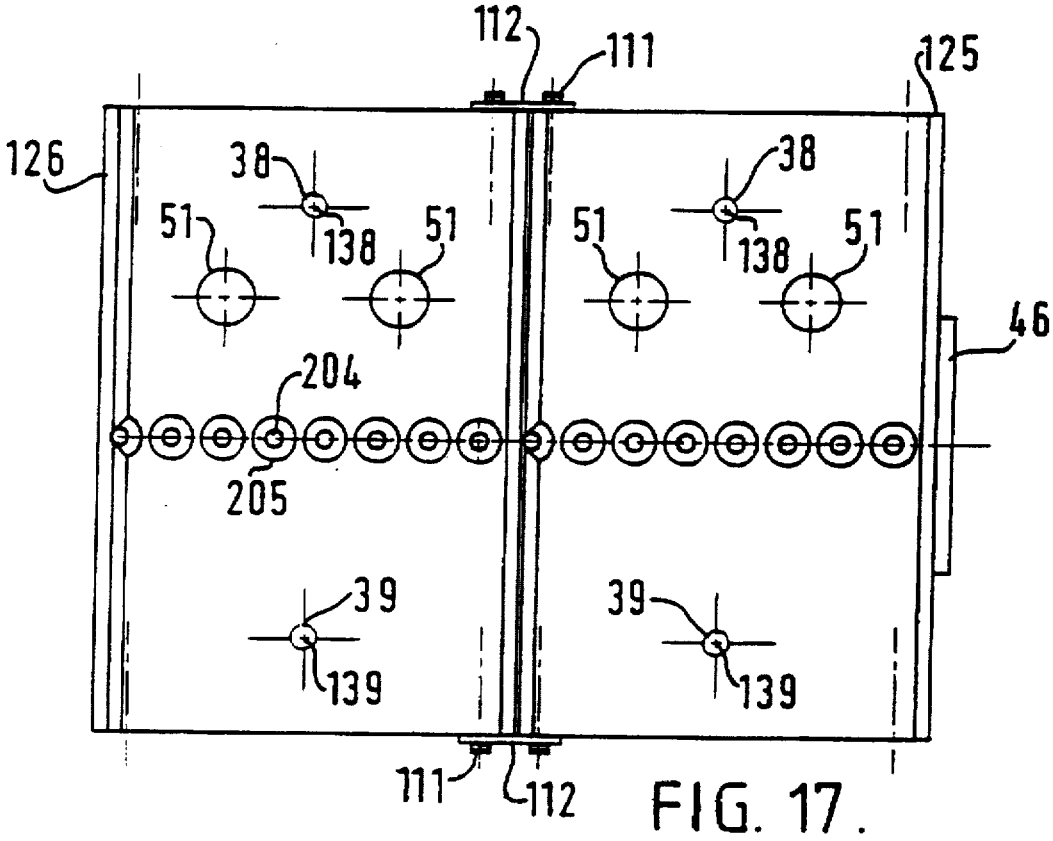
FIG. 17 is a partial side elevation of the structure shown in FIG. 16 from the inlet side (i.e. the right hand side of FIG. 16.

FIG. 17 is a side elevation of the structure shown in FIG. 16, and the links 24, which are visible are from the chain 30 and are as shown in FIG. 10. (In FIG. 11 both chains 30 and 130 have links of this appearance). The holes 204 with their inlet throats 205 are shown, as are the connections 111,112 between links and the protuberances 51. As can be seen it is preferred that a multiplicity of protuberances are provided for each link rather than a single protuberance though such could be used.

The chamfers 125 at the mating edges of the links can be seen as can the cooperating male structures 126.

The overlapping ends and cooperating male structures 126 on the masking plates 46 can be seen extending beyond one end of the links. The holes 38 and 39 in the links 24 are shown and the pins 138 and 139 (in the links which are hidden) are shown located in the holes 38 and 39 and indexing the links of the two conveyor chains.

Figure 18:
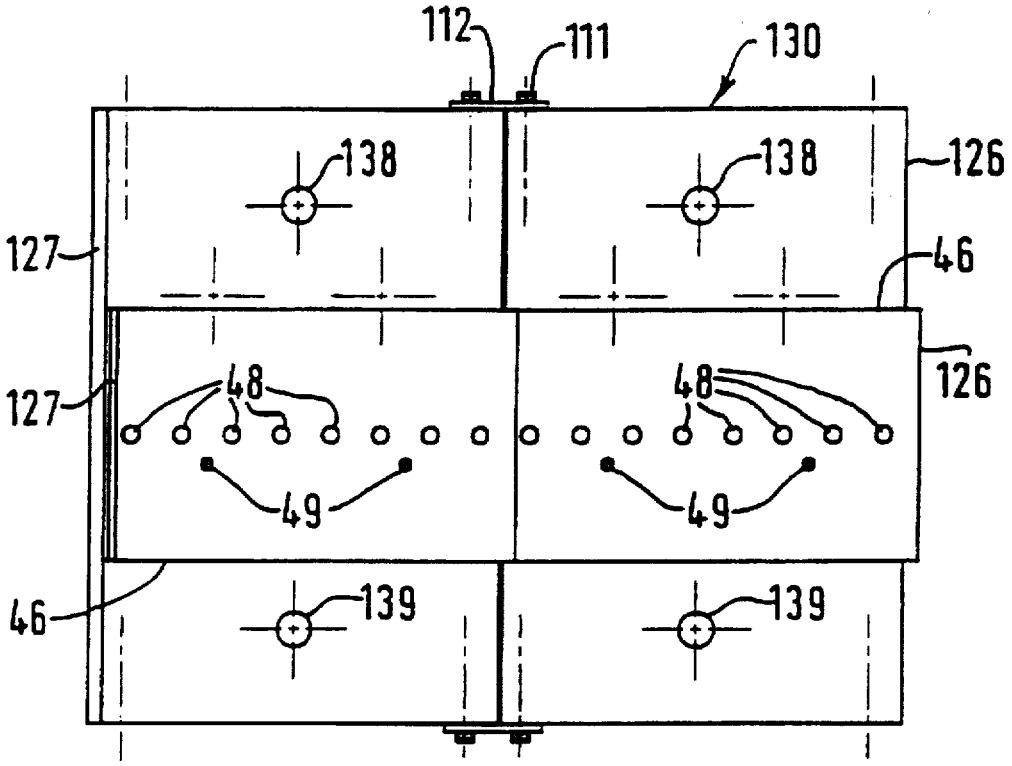
FIG. 18 is a view similar to FIG. 17 of the links on the outlet side, seen from the inner face of the links and showing the masking plates.

FIG. 18 is a view similar to FIG. 17 of the rear pair of links 24 (from the chain 130) not visible in FIG. 17. The connection 111,112 between adjacent links 24, the indexing pins 138 and 139 and the masking plates 46 can readily be seen, as can the overlap of the plates 46 beyond the edges of the links 24.

The holes 48 in the masking plates are of the special shape shown with reference to FIG. 15. Registry holes 49 for the pins 93 carried by the links in the chain 30 are also shown.

It will be recalled that these pins 93 pass through registry holes 94 in the workpiece 95 and into the holes 49.

Figure 19:
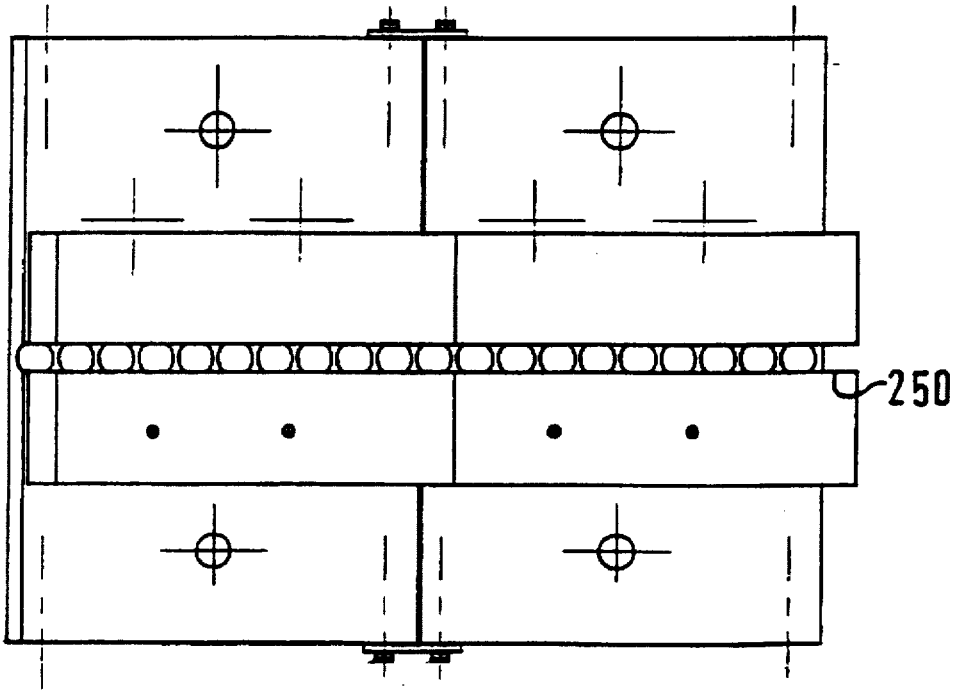
FIG. 19 is a view similar to FIG. 18 showing a modification thereof in the form of a stripe along which plating will occur.

In a modification of FIG. 18 shown in FIG. 19 the row of holes 48 is replaced by a slot or gap 250 slightly smaller in width than the holes 204 and a stripe along which plating will occur is thus defined.

It has thus been mentioned above that the chains can be pushed or pulled through the treatment zone. In addition one conveyor could be pulled and the other pushed. The arrangement could be such as to deliver the links to the workpiece indexing zone 41 pushed up against each other so that their abutting edges are in contact which would involve pushing then into than zone. Alternatively the arrangement could be such as to deliver the links to the workpiece indexing zone 41 when they are pulled out away from each other i.e. the pins are at the ends of the links 112. In either of these arrangements the indexing of the workpiece will be readily achieved as discussed with reference to FIG. 7.

Reference has mostly been made to the apparatus being used so that the workpiece is disposed vertically. The system can handle a workpiece when it is disposed horizontally just as well by rotating the system through 90°.

While preferred embodiments of the invention have been shown and described in detail, it will be apparent to those skilled in the art that various changes and modifications may be made without departing from the invention as embraced by the following claims.

We claim:

1. An apparatus for selectively electrolytically treating defined regions of a continuously moving conductive workpiece, when present in the apparatus, said apparatus comprising:

means for conveying the workpiece through an electrolytic treatment zone of the apparatus where it may be contacted with a treatment electrolyte, said conveying means having masking means to mask the workpiece such that the electrolyte contacts only the defined regions of the workpiece;

said conveying means comprising an endless chain assembly having indexing means which are operative to locate the workpiece in registry with said masking means;

means for supplying the electrolyte to the masked workpiece;

means for passing a current between the workpiece as one electrode and another electrode;

said chain assembly comprising two endless chain conveyors made of articulated links of electrically non-conductive material between which the workpiece is held while it is passed through the treatment zone, each of said conveyors being provided with indexing means which cooperate with one another to ensure that said conveyors remain in registry with each other at least in the treatment zone;

adjacent links in each of said conveyors being articulated to one another to allow relative movement between adjacent links longitudinally of the conveyor;

a first one of said conveyors extending upstream of the treatment zone beyond the other one of said conveyors, said first conveyor having said indexing means for locating the workpiece in registry with said masking means; and roller means for pressing the workpiece into engagement with said first conveyor prior to the conveyors being indexed to each other.

2. An apparatus as claimed in claim 1 wherein said indexing means comprise cooperating interengaging structures associated with said conveyors.

3. An apparatus as claimed in claim 1 wherein each of said conveyors is further provided with a support structure at least in the treatment zone, said support structures being disposed for movement toward and away from each other and having indexing means and clamping means for holding them in fixed mutually opposed relationship to permit said conveyors to slide freely therebetween in registry with one another.

4. An apparatus as claimed in claim 3 wherein said indexing means comprise cooperating inter-engaging structures associated with said support structures.

5. An apparatus as claimed in claim 1 wherein said conveyors are keyed to each other at least in the treatment zone and wherein said apparatus further comprises driving means associated with only one of said conveyors, the driven conveyor acting to carry the other conveyor in registry with itself through the treatment zone.

6. An apparatus as claimed in claim 1 wherein at least one of said conveyors is provided with a support structure and is keyed to said support structure at least in the treatment zone in such a way as to permit said conveyor to slide along the said support structure.

7. An apparatus as claimed in claim 6, wherein each of said conveyors is provided with a support structure, said conveyors being keyed to their respective support structure at least in the treatment zone in such a way to permit each conveyor to slide along its associated support structure.

8. An apparatus as claimed in claim 7 further comprising cooperating means for keying at least one of said conveyors to its associated support structure, said cooperating means comprising at least one protuberance and a mating recess.

9. An apparatus as claimed in claim 8, wherein said protuberance is located in said conveyor and said recess is located in said support structure.

10. An apparatus as claimed in claim 8 wherein said protuberance and recess define essentially triangular cross sections extending transverse to the direction of movement of said conveyor.

11. An apparatus as claimed in claim 1 wherein said conveying means include a belt, at least one of said conveyors being driven by frictional contact with said belt.

12. An apparatus as claimed in claim 1 wherein each of said conveyors is carried on a separate support structure, the support structures and their respective conveyors being movable relative to each other so as to be capable of being brought together to engage the workpiece between them and to be brought apart.

13. An apparatus as claimed in claim 12 wherein at least one of said support structures carries a belt adapted to frictionally engage the conveyor associated with said support structure to drive the said conveyor.

14. An apparatus as claimed in claim 13 wherein said drive belt has a compressible polymer surface which is located to engage the face of the links of the chain conveyor which is remote from the workpiece, said engagement occurring in the treatment zone.

15. An apparatus as claimed in claim 12 further comprising means for keying said chain conveyors to their respective support structures at least in the treatment zone.

16. An apparatus as claimed in claim 1 further comprising support means on each of said chain conveyors for supporting said chain on at least a part of its return run.

17. An apparatus as claimed in claim 1 wherein the links of at least one of said chain conveyors have apertures therein defined by said masking means, said apparatus further comprising electrolyte venting means to vent each such aperture so as to reduce any tendency to build up of electrolysis products.

18. An apparatus as claimed in claim 1 wherein the links of said chain conveyors are provided with apertures through which electrolyte may be supplied to the workpiece.

19. An apparatus as claimed in claim 18 wherein the apertures in opposed links of said chain conveyors are not in register with one another when said links are in registry the treatment zone.

20. An apparatus as claimed in claim 18 wherein the apertures in opposed links of said chain conveyors are in register with one another when said links are in registry the treatment zone.

21. An Apparatus as claimed in claim 20 wherein means are provided for feeding electrolyte through one of said conveyors from one face of the workpiece past the workpiece and out via the other face of the workpiece through the other one of said conveyors.

22. An apparatus as claimed in claim 18 wherein means are provided in said conveyors for feeding electrolyte to both faces of the workpiece.

23. An apparatus as claimed in claim 22 further comprising anodes in the treatment zone, said anodes being spaced part and disposed to face opposite faces of the workpiece when the work piece is present in the treatment zone.

24. An apparatus for selectively electrolytically treating defined regions of a continuously moving conductive workpiece, when present in the apparatus, said apparatus comprising:

means for conveying the workpiece through an electrolytic treatment zone of the apparatus where it may be contacted with a treatment electrolyte, said conveying means having masking means to mask the workpiece such that the electrolyte contacts only the defined regions of the workpiece;

said conveying means comprising an endless chain assembly having indexing means which are operative to locate the workpiece in registry with said masking means;

means for supplying the electrolyte to the masked workpiece;

means for passing a current between the workpiece as one electrode and another electrode;

said chain assembly comprising two endless chain conveyors made of articulated links of electrically non-conductive material between which the workpiece is held while it is passed through the treatment zone, each of said conveyors being provided with indexing means which cooperate with one another to ensure that said conveyors remain in registry with each other at least in the treatment zone;

adjacent links in each of said conveyors being articulated to one another to allow relative movement between adjacent links longitudinally of the conveyor;

each of said conveyors being further provided with a support structure at least in the treatment zone, the support structures and the their respective conveyors being movable relative to each other so as to be capable of being brought together to engage the workpiece between them and to be brought apart;

said support structures being provided with indexing means and clamping means for holding them in fixed mutually opposed relationship to permit said conveyors to slide freely therebetween in registry with one another;

said conveyors being keyed to their respective support structures at least in the treatment zone in such a way as to permit each conveyor to slide along its associated support structure;

belt means on at least one of said support structures adapted to frictionally engage the conveyor associated with said support structure to drive said conveyor;

a first one of said conveyors extending upstream of the treatment zone beyond the other one of said conveyors, said first conveyor having said indexing means for locating the workpiece in registry with said masking means; and roller means for pressing the workpiece into engagement with said first conveyor prior to the conveyors being indexed to each other.

25. An apparatus as claimed in claim 24 wherein the links of said chain conveyors are provided with apertures through which electrolyte may be supplied to the workpiece.

26. An apparatus as claimed in claim 24 wherein means are provided in said conveyors for feeding electrolyte to both faces of the workpiece.

27. An apparatus as claimed in claim 24 further comprising anodes in the treatment zone, said anodes being spaced apart and disposed to face opposite faces of the workpiece when the workpiece is present in the treatment zone.

28. An apparatus as claimed in claim 24 further comprising cooperating means for keying said conveyors to their respective support structures, said cooperating means comprising at least one protuberance and a mating recess defining essentially triangular cross sections extending transverse to the direction of movement of said conveyors.

* * * * *